US012031303B2

(12) United States Patent
Ishihara et al.

(10) Patent No.: US 12,031,303 B2
(45) Date of Patent: Jul. 9, 2024

(54) WORK MACHINE

(71) Applicant: HITACHI CONSTRUCTION MACHINERY CO., LTD., Tokyo (JP)

(72) Inventors: Shinji Ishihara, Tokyo (JP); Shiho Izumi, Tsuchiura (JP); Yasuhiko Kanari, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 444 days.

(21) Appl. No.: 17/414,347

(22) PCT Filed: Nov. 21, 2019

(86) PCT No.: PCT/JP2019/045570
§ 371 (c)(1),
(2) Date: Jun. 16, 2021

(87) PCT Pub. No.: WO2020/137275
PCT Pub. Date: Jul. 2, 2020

(65) Prior Publication Data

US 2022/0056674 A1 Feb. 24, 2022

(30) Foreign Application Priority Data

Dec. 27, 2018 (JP) ..... 2018-245437

(51) Int. Cl.
*E02F 9/26* (2006.01)
*E02F 3/32* (2006.01)

(52) U.S. Cl.
CPC ..... *E02F 9/264* (2013.01); *E02F 3/32* (2013.01)

(58) Field of Classification Search
CPC ..... E02F 3/32; E02F 9/264
See application file for complete search history.

(56) References Cited

U.S. PATENT DOCUMENTS

2018/0171598 A1* 6/2018 Iwamura ..... E02F 3/435
2019/0345697 A1* 11/2019 Ishihara ..... E02F 3/435

FOREIGN PATENT DOCUMENTS

JP 2015-1385 A 1/2015
JP 2018-155027 A 10/2018
WO 2017/072877 A1 5/2017

OTHER PUBLICATIONS

International Preliminary Report on Patentability received in corresponding International Application No. PCT/JP2019/045570 dated Jul. 8, 2021.
International Search Report of PCT/JP2019/045570 dated Feb. 10, 2020.

* cited by examiner

*Primary Examiner* — Anne Marie Antonucci
*Assistant Examiner* — Jared C Bean
(74) *Attorney, Agent, or Firm* — MATTINGLY & MALUR, PC

(57) ABSTRACT

An installation error of a machine-body inertial measurement unit around a first axis is computed on a basis of sensing results of inertial measurement units of a front work implement, and the machine-body inertial measurement unit obtained while the upper swing structure is in a first calibration posture in which the upper swing structure faces a predetermined direction relative to a lower travel structure; and an installation error of the machine-body inertial measurement unit around a second axis is computed on a basis of a sensing result of the machine-body inertial measurement unit obtained while the upper swing structure is in a second calibration posture in which the upper swing structure is swung by 90 degrees relative to the lower travel structure from the first calibration posture, and the installation error of the machine-body inertial measurement unit around the first axis.

2 Claims, 15 Drawing Sheets

WORK MACHINE

TECHNICAL FIELD

The present invention relates to a work machine having a work implement.

BACKGROUND ART

In recent years, along with efforts to support computerized construction, there are practically-used work machines that have: a machine guidance function of displaying, to an operator, a posture of a work implement having driven members such as a boom, an arm or a bucket, and a position of a work device such as the bucket; a machine control function of performing control such that the work device such as the bucket moves along a construction-target surface; and the like. Representative ones of such functions display, on a monitor, the bucket-tip position and bucket angle of a hydraulic excavator, and limit operation such that the bucket tip does not become closer to a construction-target surface at a distance equal to or smaller than a certain distance.

The realization of such functions requires posture calculations of a work implement. The higher the precision of the posture calculations is, the higher the quality of construction that can be realized is. For calculations of the posture of the work implement, for example, potentiometers, and sensors such as inertial measurement units (IMUs) need to be used to sense respective rotation angles of a boom, an arm and a bucket.

In addition, for highly-precise posture calculations, it is necessary to accurately grasp the installation positions, angles and the like of the sensors. However, in the actual use, installation errors occur when the sensors are installed on the work machine. Accordingly, for accurate calculations of the posture of the work implement of the work machine, it is necessary to provide some calibration means for correcting such errors.

As such a technology related to calibrations of sensors, for example, Patent Document 1 discloses a construction machine including: a lower travel structure; and an upper swing structure provided on the lower travel structure such that the upper swing structure becomes swingable about a preset swing axis. The construction machine includes: an X axis gyro sensor that senses an angular velocity about a preset X sensing axis; a Y axis gyro sensor that senses an angular velocity about a Y sensing axis orthogonal to the X sensing axis; a Z axis gyro sensor that senses an angular velocity about a Z sensing axis orthogonal to the X sensing axis and the Y sensing axis; and angular-velocity computing means that computes an angular velocity of the upper swing structure about the swing axis on a basis of a result of sensing by each of the gyro sensors. The angular-velocity computing means performs a coordinate transformation of a three-dimensional coordinate system for sensing defined by the X sensing axis, the Y sensing axis and the Z sensing axis into a reference three-dimensional coordinate system defined by a Z reference axis coinciding with the swing axis, and an X reference axis and a Y reference axis that are orthogonal to each other on a plane orthogonal to the Z reference axis. Thereby, the angular-velocity computing means corrects a displacement between the three-dimensional coordinate system for sensing and the reference three-dimensional coordinate system, and computes an angular velocity about the Z reference axis. For this purpose, (A) by using the fact that, when the Z sensing axis has rotated by a first angle about the X reference axis relative to the Z reference axis, and has rotated by a second angle about the Y reference axis relative to the Z reference axis, angular velocities represented by two relational expressions related to the X reference axis and the Y reference axis in three relational expressions representing angular velocities about the three axes in the reference three-dimensional coordinate system by using the result of the sensing by each of the gyro sensors, the first angle and the second angle are each 0, the angular-velocity computing means computes the first angle and the second angle on a basis of those two relational expressions, and (B) the angular-velocity computing means computes the angular velocity about the Z reference axis on a basis of a relational expression related to the Z reference axis in the three relational expressions, and the computed first angle and second angle.

PRIOR ART DOCUMENT

Patent Document

Patent Document 1: JP-2015-1385-A

SUMMARY OF THE INVENTION

Problem to be Solved by the Invention

However, as has been known generally, outputs of gyro sensors have some bias (gyro bias), and accordingly, the gyro sensors inevitably output some values even in axial directions in which angular velocities are not actually generated. In addition, because the gyro bias significantly changes due to the temperatures of sensor elements and the like inevitably, it can be considered that the precision of calibrations varies significantly depending on environments where calibration operation is performed. Accordingly, in the conventional technology described above that does not take the influence of the gyro bias into consideration, output values from gyro sensors are values that have errors from true installation angles due to the influence of the gyro bias.

In addition, in the conventional technology described above, in a process of the calibration, the arc tangent function (tan ^(−1)) is used, the swing angular velocity ωz is included in the denominator portion which is a variable of the arc tangent function, and the angular velocity ωy is included in the numerator portion which is a variable of the arc tangent function. The swing angular velocity ωz in the denominator needs to be increased to reduce the influence of the noise of the angular velocity ωy and the like. However, it is difficult to increase the swing speed to a speed that accompanies the swing angular velocity ωz which reduces the influence of the noise of the angular velocity ωy and the like, and the precision of the calibration cannot be enhanced.

The present invention has been made in view of the above, and an object of the present invention is to provide a work machine that makes it possible to precisely compute installation errors of sensors for sensing postural information, and to enhance the sensor calibration precision.

Means for Solving the Problem

The present application includes plural means for solving the problem described above, and one example thereof is a work machine including: a machine body including a lower travel structure, and an upper swing structure swingably provided to the lower travel structure; an articulated-type work implement that is installed on the machine body, and includes a plurality of pivotably-coupled front-implement members; one or more first-posture sensors that are provided to at least one front-implement member of the work implement, and that sense postural information of the at least one front-implement member; a second-posture sensor that is provided to the upper swing structure, and that senses postural information of the upper swing structure; and a controller configured to compute an installation error of the second-posture sensor, in which the controller is configured to compute an installation error of the second-posture sensor around a first axis that is set forward perpendicularly to a swing axis of the upper swing structure, on a basis of sensing results of the first-posture sensors and the second-posture sensor obtained while the upper swing structure is in a first calibration posture in which the upper swing structure faces a predetermined direction relative to the lower travel structure, and compute an installation error of the second-posture sensor around a second axis that is set laterally perpendicularly to the swing axis of the upper swing structure, and to the first axis, on a basis of a sensing result of the second-posture sensor obtained while the upper swing structure is in a second calibration posture in which the upper swing structure is swung by 90 degrees relative to the lower travel structure from the first calibration posture, and the installation error of the second-posture sensor around the first axis.

Advantages of the Invention

The present invention makes it possible to precisely compute installation errors of sensors for sensing postural information, and to enhance the sensor calibration precision.

MODES FOR CARRYING OUT THE INVENTION

In the following, embodiments of the present invention are explained with reference to the drawings. Note that, while a hydraulic excavator including a bucket as a work device at the tip of a front work implement is illustrated and explained as an example work machine in the present embodiment, it is also possible to apply the present invention to a hydraulic excavator including an attachment such as a breaker or a magnet other than a bucket.

First Embodiment

A first embodiment of the present invention is explained with reference to FIG. 1 to FIG. 12.

Figure 1:
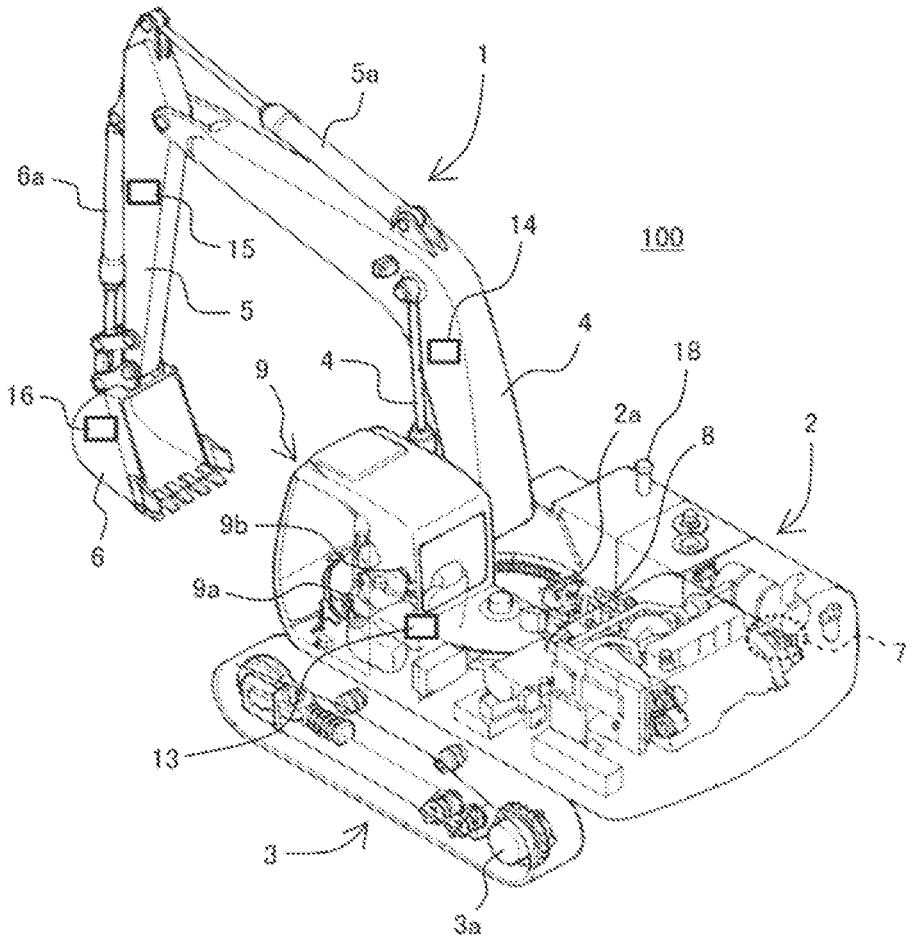
FIG. 1 is a figure schematically illustrating an external appearance of a hydraulic excavator which is an example work machine according to a first embodiment.

FIG. 1 is a figure schematically illustrating an external appearance of a hydraulic excavator which is an example work machine according to the present embodiment.

In FIG. 1, a hydraulic excavator 100 includes: an articulated-type front work implement (work implement) 1 including a plurality of mutually-coupled driven members (a boom 4, an arm 5 and a bucket (work device) 6) that individually pivot vertically; and an upper swing structure 2 and a lower travel structure 3 included in a machine body. The upper swing structure 2 is provided swingably relative to the lower travel structure 3. In addition, the base end of the boom 4 of the front work implement 1 is vertically-pivotably supported at a front section of the upper swing structure 2. One end of the arm 5 is vertically-pivotably supported at an end section (tip) of the boom 4 different from the base end. The bucket 6 is vertically-pivotably supported at the other end of the arm 5. The boom 4, the arm 5, the bucket 6, the upper swing structure 2 and the lower travel structure 3 are driven by a boom cylinder 4*a*, an arm cylinder 5*a*, a bucket cylinder 6*a*, a swing motor 2*a* and left and right travel motors 3*a* (n.b. only one travel motor is illustrated) which are hydraulic actuators, respectively.

The boom 4, the arm 5 and the bucket 6 operate on a plane including the front work implement 1, and hereinafter the plane is referred to as an operation plane in some cases. That is, the operation plane is a plane orthogonal to the pivot axes of the boom 4, the arm 5 and the bucket 6, and can be set at the widthwise center of the boom 4, the arm 5 and the bucket 6.

In a cab 9 which an operator gets on, operation levers (operation devices) 9*a* and 9*b* for outputting operation signals for operating the hydraulic actuators 2*a* to 6*a* are provided. Although not illustrated, the operation levers 9*a* and 9*b* can be inclined forward, backward, leftward and rightward individually, and include sensors which are not illustrated, but electrically detect lever inclination amounts which are operation signals, that is, lever operation amounts. The operation levers 9*a* and 9*b* output the lever operation amounts sensed by the sensors to a controller 20 which is a controller (see FIG. 2 below) via electric wires. That is, each of the forward direction, the backward direction, the rightward direction and the leftward direction of each of the operation levers 9*a* and 9*b* is allocated to the operation of one of the hydraulic actuators 2*a* to 6*a*. Note that, although a detailed explanation is omitted, a travel operation lever that outputs an operation signal for operating the travel motors 3*a* is also provided in the cab 9.

Operation control of the boom cylinder 4*a*, the arm cylinder 5*a*, the bucket cylinder 6*a*, the swing motor 2*a* and the left and right travel motors 3*a* is performed by a control valve 8 controlling the direction and flow rate of a hydraulic operating fluid supplied to each of the hydraulic actuators 2*a* to 6*a* from a hydraulic pump apparatus 7 driven by a prime mover such as an engine or an electric motor, which is not illustrated. The control of the control valve 8 is performed by drive signals (pilot pressures) output from a pilot pump, which is not illustrated, via a solenoid proportional valve. By controlling the solenoid proportional valve by the controller 20 on the basis of operation signals from the operation levers 9*a* and 9*b*, the operation of each of the hydraulic actuators 2*a* to 6*a* is controlled.

Note that the operation levers 9*a* and 9*b* may be hydraulic pilot operation levers. Each of the operation levers 9*a* and 9*b* may be configured to supply the control valve 8 with, as a drive signal, a pilot pressure according to the operation direction and operation amount of each of the operation levers 9*a* and 9*b* operated by an operator, and drive each of the hydraulic actuators 2*a* to 6*a*.

At an upper section of the upper swing structure 2, a reception antenna 18 for a GNSS (Global Navigation Satellite System) is arranged, and, on the basis of a signal received at the reception antenna 18, a position calculating device, which is not illustrated, performs a calculation of the position of the hydraulic excavator 100 in the geocentric coordinate system.

Inertial measurement units (IMUs: Inertial Measurement Units) 13 to 16 are arranged as posture sensors on the upper swing structure 2, the boom 4, the arm 5, and the bucket 6, respectively. Hereinafter, when it is necessary to distinguish between those inertial measurement units, they are referred to as a machine-body inertial measurement unit 13, a boom inertial measurement unit 14, an arm inertial measurement unit 15, and a bucket inertial measurement unit 16, respectively.

The inertial measurement units 13 to 16 measure angular velocities and accelerations. If a case that the upper swing structure 2, and the driven members 4 to 6 on which the inertial measurement units 13 to 16 are arranged stay stationary is considered, on the basis of the direction of the gravitational acceleration (i.e. the vertically downward direction) in the IMU coordinate systems set for the inertial measurement units 13 to 16, and the installation states of the inertial measurement units 13 to 16 (i.e. the relative positional relations between the inertial measurement units 13 to 16, and the upper swing structure 2, and the driven members 4 to 6), the directions of the driven members 4 to 6 (ground angles: angles relative to the horizontal direction), the ground angle of the upper swing structure 2 in the forward/backward direction (pitch angle), and the ground angle of the upper swing structure 2 in the leftward/rightward direction (roll angle) can be sensed. Here, the inertial measurement units 14 to 16 are included in a postural information sensor that senses information related to the posture of each of the plurality of driven members (hereinafter, referred to as postural information).

Figure 2:
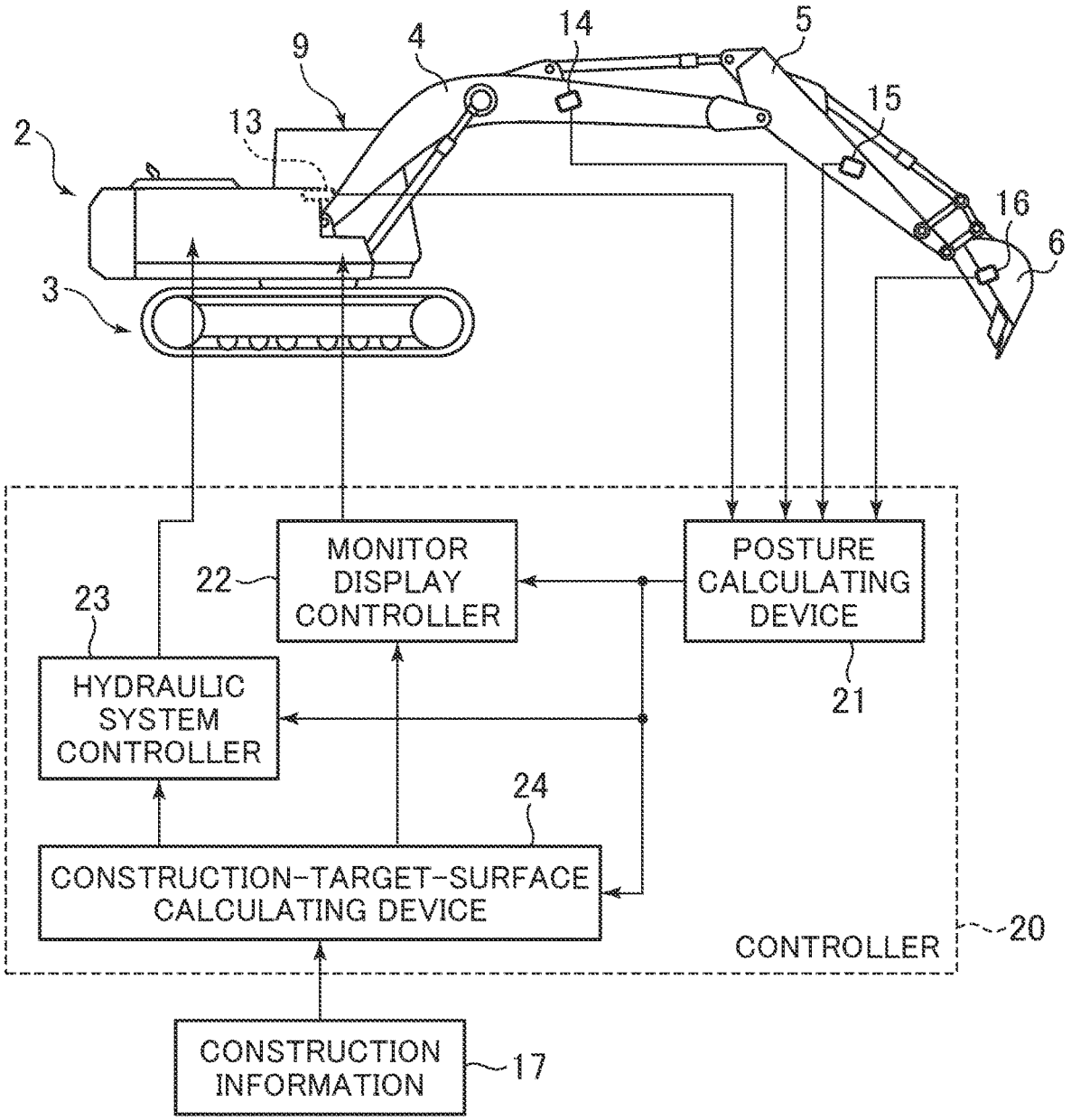
FIG. 2 is a figure schematically illustrating some of processing functions of a controller mounted on the hydraulic excavator.

FIG. 2 is a figure schematically illustrating some of processing functions of the controller mounted on the hydraulic excavator.

In FIG. 2, the controller (controller) 20 is mounted at a predetermined position of the hydraulic excavator 100, has various functionalities for controlling the operation of the hydraulic excavator 100, and has, as part of itself, functional sections including a posture calculating device 21, a monitor display controller 22, a hydraulic system controller 23, and a construction-target-surface calculating device 24.

The posture calculating device 21 performs a posture calculation process (mentioned below) of calculating postural information of the hydraulic excavator 100 including the front work implement 1, on the basis of sensing results from the inertial measurement units 13 to 16. Note that, when the posture of the hydraulic excavator 100 is calculated in the posture calculating device 21, the angles of the machine body (the upper swing structure 2 and the lower travel structure 3), the boom 4, the arm 5, and the bucket 6 are necessary. The posture calculating device 21 transforms postural information (ground angles: angles relative to the horizontal direction) of the inertial measurement units 13 to 16 themselves input as sensing signals from the inertial measurement units 13 to 16 into the posture of the hydraulic excavator 100.

The construction-target-surface calculating device 24 calculates a construction-target surface defining the construction-subject target shape on the basis of construction information 17 such as a three-dimensional construction drawing stored by a construction administrator in advance on a storage device or the like, which is not illustrated.

The monitor display controller 22 controls the display on a monitor, which is not illustrated, provided in the cab 9. The monitor display controller 22 calculates an instruction content of operation assistance for an operator, on the basis of the construction-target surface calculated at the construction-target-surface calculating device 24, and the posture of the hydraulic excavator 100 calculated at the posture calculating device 21, and displays the instruction content on the monitor in the cab 9. That is, the monitor display controller 22 is responsible for part of a function as a machine guidance system that displays, on the monitor, the posture of the front work implement 1 having driven members such as the boom 4, the arm 5, and the bucket 6, the tip position and angle of the bucket 6, the relative positions of the bucket 6 and the construction-target surface, and the like and that assists operation by the operator, for example.

The hydraulic system controller 23 controls the hydraulic system of the hydraulic excavator 100 including the hydraulic pump apparatus 7, the control valve 8, the hydraulic actuators 2*a* to 6*a*, and the like. The hydraulic system controller 23 calculates operation of the front work implement 1 on the basis of the construction-target surface calculated at the construction-target-surface calculating device 24, and the posture of the front work implement 1 calculated at the posture calculating device 21, and controls the hydraulic system of the hydraulic excavator 100 so as to realize the operation. That is, the hydraulic system controller 23 is responsible for part of a function as a machine control system that: limits operation such that the tip of a work device such as the bucket 6 does not become closer to the construction-target surface at a distance equal to or smaller than a certain distance; performs control such that a work device (e.g. the claw tip of the bucket 6) moves along the construction-target surface; and so on, for example.

Figure 3:
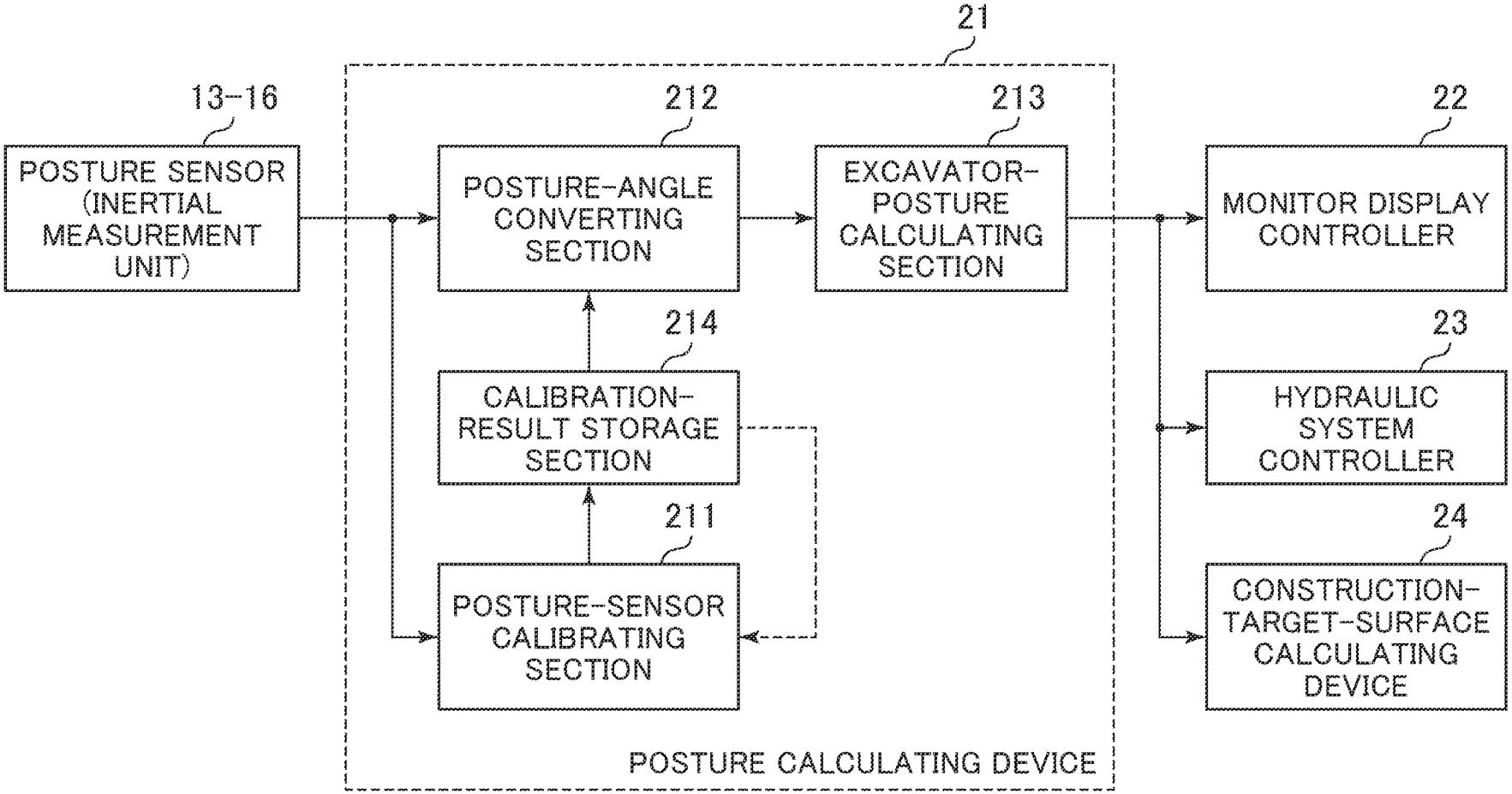
FIG. 3 is a functional block diagram schematically illustrating a processing function of a posture calculating device of the controller.
Figure 4:
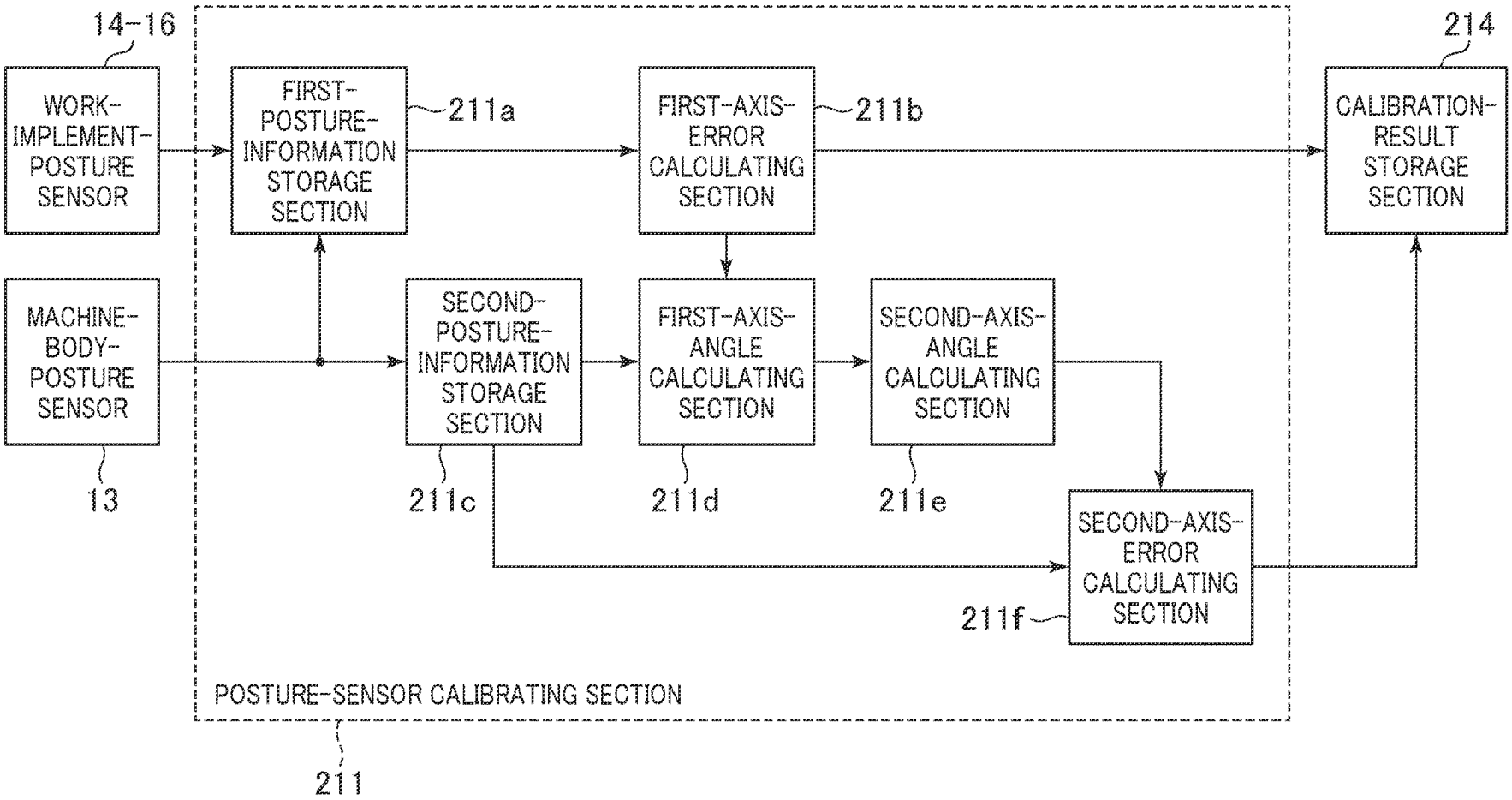
FIG. 4 is a functional block diagram schematically illustrating a processing function of a posture-sensor calibrating section.
Figure 5:
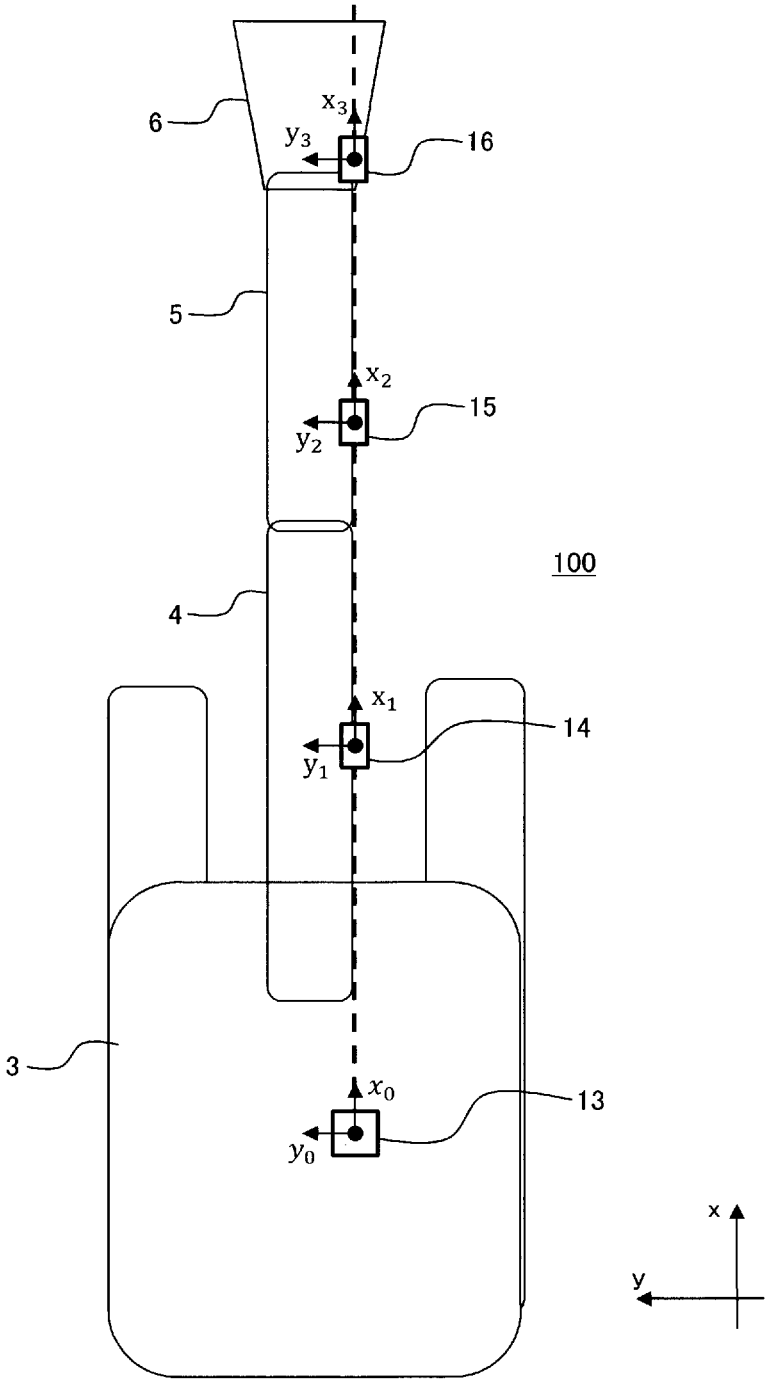
FIG. 5 is a top view of the hydraulic excavator.
Figure 6:
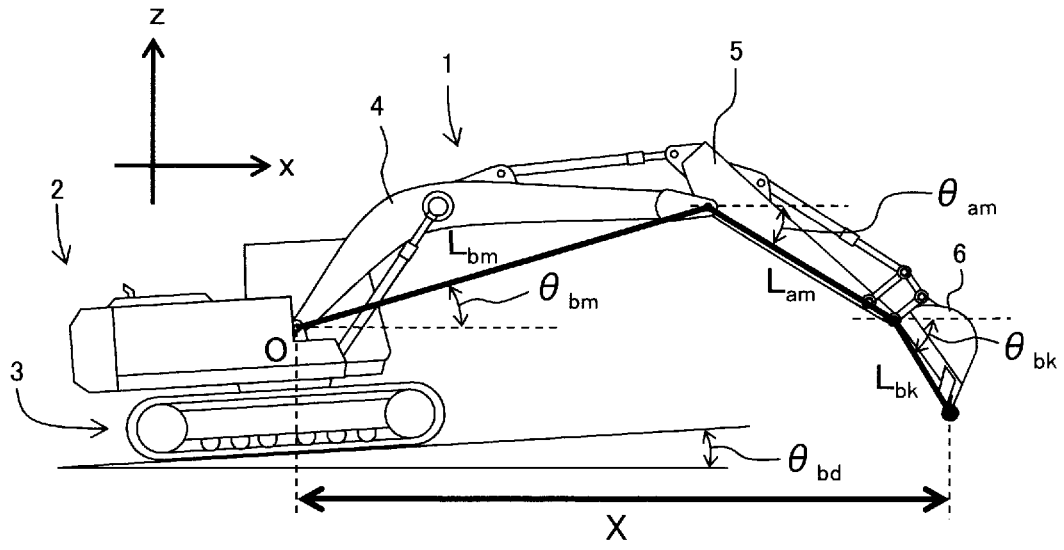
FIG. 6 is a side view of the hydraulic excavator.
Figure 7:
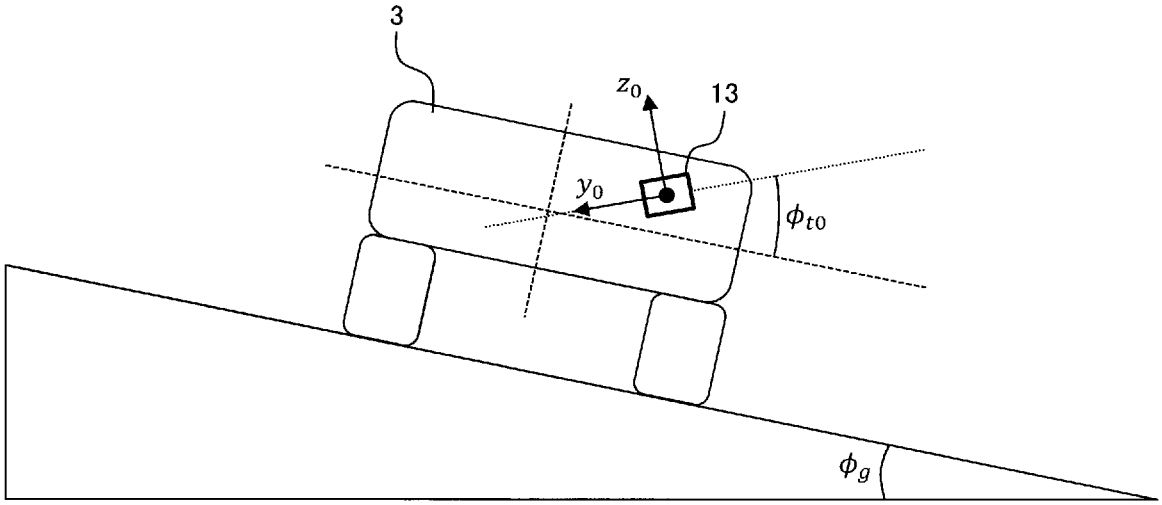
FIG. 7 is a rear view of the hydraulic excavator.
Figure 8:
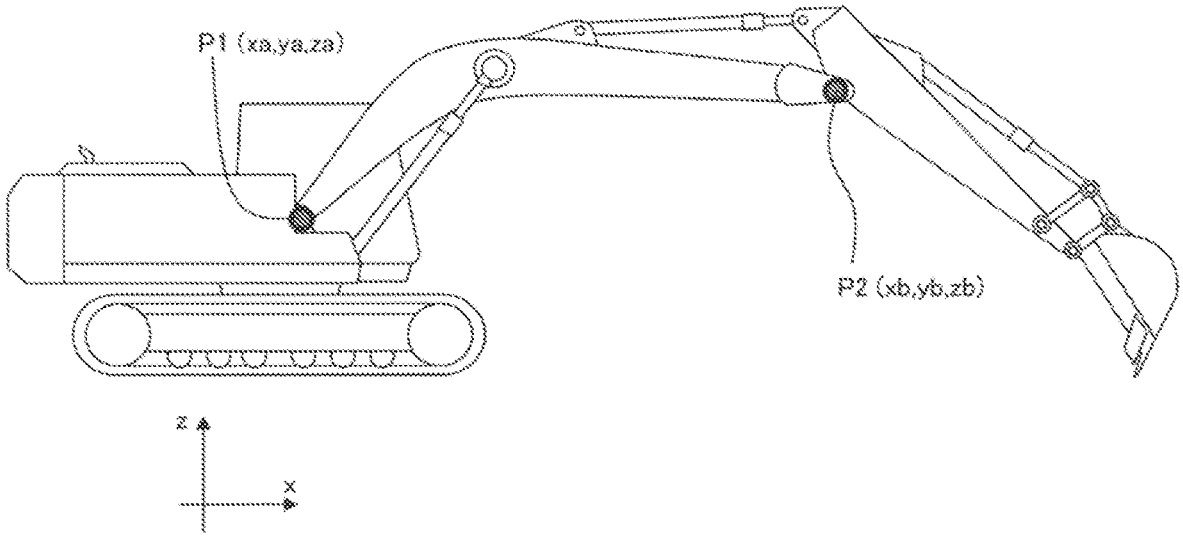
FIG. 8 is a side view of the hydraulic excavator.

FIG. 3 is a functional block diagram schematically illustrating a processing function of the posture calculating device of the controller, and FIG. 4 is a functional block diagram schematically illustrating a processing function of a posture-sensor calibrating section of the posture calculating device. In addition, FIG. 5 to FIG. 8 are figures illustrating: the position where each inertial measurement unit is placed on the hydraulic excavator; the relation of the hydraulic excavator and each inertial measurement unit with a preset coordinate system; and the like. FIG. 5 is a top view of the hydraulic excavator, FIG. 6 and FIG. 8 are side views of the hydraulic excavator, and FIG. 7 is a rear view of the hydraulic excavator.

First, the basic principle of a calibration process in the present embodiment is explained.

As illustrated in FIG. 5 to FIG. 8, in the present embodiment, as the coordinate system of a space in which the hydraulic excavator 100 is arranged, an x axis is set in the horizontally forward direction from the upper swing structure 2, a y axis is set in the horizontally leftward direction that is perpendicular to the x axis, and a z axis is set in the vertically upward direction. In addition, it is defined that the positive direction of a roll angle is the clockwise direction from the direction of the x axis, and the positive direction of a pitch angle is the upward direction from the direction of the x axis. Note that, in the following explanation, "bd" given as suffixes of variables indicate that the variables are related to the machine body, "bm" given as suffixes of variables indicate that the variables are related to the boom 4, "am" given as suffixes of variables indicate that the variables are related to the arm 5, and "bk" given as suffixes of variables indicate that the variables are related to the bucket 6.

As illustrated in FIG. 6, in the coordinate system defined in the present embodiment, for example, if the link lengths of the driven members (the boom 4, the arm 5, and the bucket (work device) 6) of the front work implement 1 are Lbm, Lam, and Lbk, respectively, and the posture angles (ground angles: angles relative to the horizontal direction) of the upper swing structure 2, and the driven members 4 to 6 of the front work implement 1 are θbd, θbm, θam, and θbk, respectively, a horizontal distance X from the center of the pivoting motion at an end section of the boom 4 on the side of the machine body to the claw tip of the bucket 6 can be obtained from (Formula 1) described below.

[Equation 1]

$$X = L_{bm} \times \cos(\theta_{bm} - \theta_{bd}) + L_{am} \times \cos(\theta_{am} - \theta_{bd}) + L_{bk} \times \cos(\theta_{bk} - \theta_{bd}) \quad \text{(Formula 1)}$$

As illustrated in FIG. 5, as sensor axes in the sensing of an acceleration, the machine-body inertial measurement unit 13 sets the z axis in the upward direction along the swing axis of the upper swing structure 2, the x axis in the forward direction which is perpendicular to the z axis, and the y axis in the leftward direction which is perpendicular to the z axis and the x axis. Similarly, as sensor axes in the sensing of an acceleration, the inertial measurement units 14 to 16 set the x axis in the forward direction of the link-length direction of the driven members 4 to 6, the y axis in the leftward direction which is perpendicular to the operation plane of the front work implement 1 relative to the direction of the x axis, and the z axis in the upward direction which is perpendicular to the x axis and the y axis. In addition, a sensed value of the machine-body inertial measurement unit 13 is expressed as (x0, y0, z0), a sensed value of the boom inertial measurement unit 14 is expressed as (x1, y1, z1), a sensed value of the arm inertial measurement unit 15 is expressed as (x2, y2, z2), and a sensed value of the bucket inertial measurement unit 16 is expressed as (x3, y3, z3). Here, for example, it is assumed that the machine-body inertial measurement unit 13 is installed on the upper swing structure 2, with an installation error θt0 in the pitch direction, and a roll-direction installation error φt0.

In addition, as illustrated in FIG. 7, a situation where the hydraulic excavator 100 is placed on a slope with an angle (inclination angle) φg is considered. In FIG. 5, assuming that the hydraulic excavator 100 stays stationary, the only acceleration sensed at the machine-body inertial measurement unit 13 is a gravitational acceleration G. Because of this, if the roll angle (ground angle) of the machine-body inertial measurement unit 13 itself is φ0, the accelerations of the sensor axes in the y-axis and z-axis directions can be obtained in accordance with (Formula 2) and (Formula 3) described below.

[Equation 2]

$$y_0 = G \cos \phi_0 \quad \text{(Formula 2)}$$

[Equation 3]

$$z_0 = -G \sin \phi_0 \quad \text{(Formula 3)}$$

That is, by using the accelerations y0 and z0 computed in accordance with (Formula 2) and (Formula 3) described above, the machine-body inertial measurement unit 13 can compute the roll angle of the machine-body inertial measurement unit 13 itself in accordance with (Formula 4) described below.

[Equation 4]

$$\phi_0 = \tan^{-1} \frac{y_0}{z_0} \quad \text{(Formula 4)}$$

Here, the roll angle φ0 of the machine-body inertial measurement unit 13 itself obtained in accordance with (Formula 4) described above is the difference between the installation error φt0 and the slope angle φg as illustrated in (Formula 5) described below.

[Equation 5]

$$\phi_0 = \phi_g - \phi_{t0} \quad \text{(Formula 5)}$$

The calculation of (Formula 5) described above about the machine-body inertial measurement unit 13 can similarly be performed for each of the boom inertial measurement unit 14, the arm inertial measurement unit 15, and the bucket inertial measurement unit 16 provided to the front work implement 1. That is, if the roll angle and installation error of each of the inertial measurement units 14 to 16 is φi and φti (i=1 to 3), respectively, (Formula 6) to (Formula 8) described below can be obtained about the boom 4, the arm 5, and the bucket 6, respectively.

[Equation 6]

$$\phi_1 = \phi_g - \phi_{t1} \quad \text{(Formula 6)}$$

[Equation 7]

$$\phi_2 = \phi_g - \phi_{t2} \quad \text{(Formula 7)}$$

[Equation 8]

$$\phi_3 = \phi_g - \phi_{t3} \quad \text{(Formula 8)}$$

Next, the calculation of each installation error about a roll angle is explained.

Generally, the distribution of installation errors of sensors such as inertial measurement units is a normal distribution whose average value is 0 (zero). Accordingly, in accordance with this principle, the sum total of installation errors of the inertial measurement units 13 to 16 is 0 (zero). That is, because the sum total of (Formula 5) to (Formula 8) described above becomes 0 (zero), the slope angle φg can be obtained in accordance with (Formula 9) described below.

[Equation 9]

$$\phi_g = \frac{\phi_0 + \phi_1 + \phi_2 + \phi_3}{4} \quad \text{(Formula 9)}$$

By assigning the slope angle φg obtained in accordance with (Formula 9) described above to (Formula 5) described above, the installation error φt0 can be computed as in (Formula 10) described below.

[Equation 10]

$$\phi_{t0}=\phi_g-\phi_0 \quad \text{(Formula 10)}$$

Next, a calculation of the slope angle is explained.

In accordance with (Formula 10) described above, the roll-direction installation error φt0 has already been computed. Accordingly, by using the sensing result (output value) of the machine-body inertial measurement unit 13, the inclination angle φg of the slope can be computed in accordance with (Formula 11) described below by using (Formula 4) and (Formula 5) described above used for the calculation about the roll angle.

[Equation 11]

$$\phi_g-\phi_0-\phi_{t0} \quad \text{(Formula 11)}$$

Next, a calculation of a pitch-angle installation error is explained.

Similarly to the case of the calculation of the roll angle, when the machine body stays stationary, if the pitch angle of the machine-body inertial measurement unit 13 itself is 00, the accelerations of the sensor axes in the x-axis and z-axis directions can be obtained in accordance with (Formula 12) and (Formula 13) described below.

[Equation 12]

$$x_0=-G\cos\theta_0 \quad \text{(Formula 12)}$$

[Equation 13]

$$z_0=-G\sin\phi_0 \quad \text{(Formula 13)}$$

That is, by using the accelerations x0 and z0 computed in accordance with (Formula 12) and (Formula 13) described above, the machine-body inertial measurement unit 13 can compute the pitch angle of the machine-body inertial measurement unit 13 itself in accordance with (Formula 14) described below.

[Equation 14]

$$\theta_0 = \tan^{-1}\frac{x_0}{z_0} \quad \text{(Formula 14)}$$

Here, the pitch angle θ0 of the machine-body inertial measurement unit 13 itself obtained in accordance with (Formula 14) described above is the difference between the installation error φt0 and the true pitch angle θ0r as represented by (Formula 15) described below.

[Equation 15]

$$\theta_0=\theta_{0r}-\theta_{t0} \quad \text{(Formula 15)}$$

Figure 9:
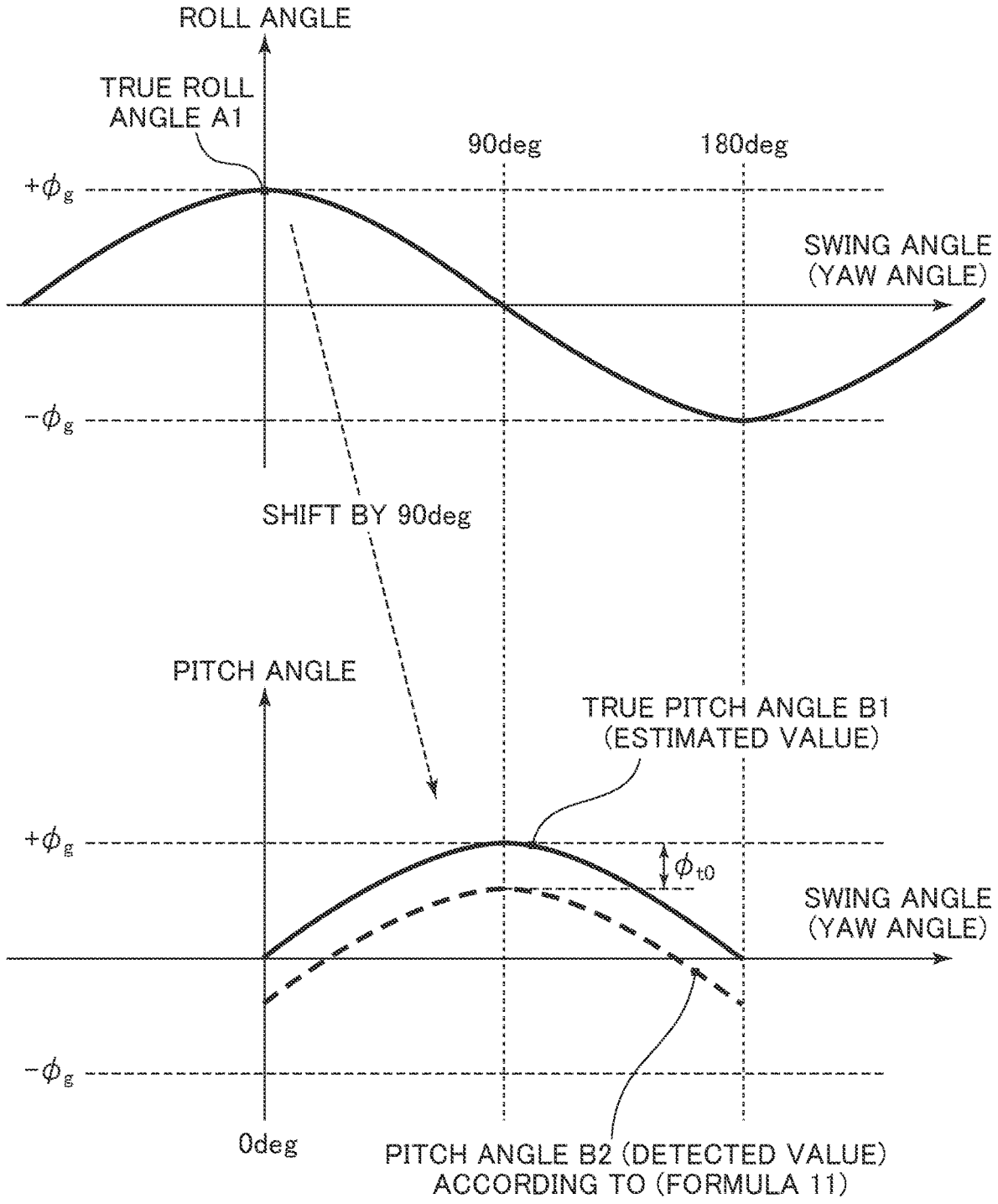
FIG. 9 is a figure illustrating one example of changes of roll-angle and pitch-angle measurement results of a machine-body inertial measurement unit when an upper swing structure is swung relative to a lower travel structure.

FIG. 9 is a figure illustrating one example of changes of roll-angle and pitch-angle measurement results of the machine-body inertial measurement unit when the upper swing structure is swung relative to the lower travel structure. The horizontal axes represent the swing angle, and the vertical axes represent the roll angle and the pitch angle.

As illustrated in FIG. 9, if the upper swing structure 2 is swung relative to the lower travel structure 3, sensed values of the machine-body inertial measurement unit 13 represent a sine curve having an amplitude which is twice the value of the inclination angle φg at the arrangement position of the machine body (2φg), irrespective of the installation error θt0. In addition, the roll angle and the pitch angle sensed by the machine-body inertial measurement unit 13 match when the upper swing structure 2 is swung by 90 degrees in the yaw direction (about the swing axis), and have the relation of a sine curve and a cosine curve in relation to the swing angle. Accordingly, as illustrated in FIG. 9, for example, a true pitch angle B1 at the swing angle of 90 degrees can be estimated from the value of a true roll angle A1 at the swing angle of 0 degrees (i.e. the value to which φ0 computed at (Formula 4) described above, and the installation error φt0 are applied). Then, the installation error θt0 can be computed by subtracting the value of the pitch angle B2 computed in accordance with (Formula 14) described above from the thus-determined true pitch angle B1 (estimated value) at the swing angle of 90 degrees. Note that, in order to compute the pitch angle at the swing angle of 90 degrees in accordance with (Formula 14) described above, it is necessary to actually swing the upper swing structure 2 by 90 degrees from the initial posture (first posture: the posture at which the forward direction of the lower travel structure 3, and the forward direction of the upper swing structure 2 are aligned; the state where the swing angle is 0 degrees).

In the present embodiment, calibrations of sensed values of the machine-body inertial measurement unit 13 are performed by computing the roll-angle installation error ρt0, and the pitch-angle installation error θt0 of the machine-body inertial measurement unit 13 on the basis of the basic principle mentioned above. The processing function of the controller 20 related to such calibrations of the machine-body inertial measurement unit 13 is explained in detail below.

In FIG. 3, the posture calculating device 21 performs a posture calculation process of calculating the posture of the front work implement 1 on the basis of sensing results from the inertial measurement units 13 to 16. The posture calculating device 21 has functional sections including a posture-sensor calibrating section 211, a posture-angle transforming section 212, an excavator-posture calculating section 213, and a calibration-result storage section 214.

In accordance with a calculation method mentioned below, the posture-sensor calibrating section 211 calculates an error (installation-angle error θt) of the installation angle of each inertial measurement unit 13 to 16 relative to a corresponding section. The calculated installation-angle error θt is fed to the calibration-result storage section 214, and stored therein. Note that the posture-sensor calibrating section 211 may use, as initial calibration values, a previous calibration result stored in the calibration-result storage section 214, in order to attempt to shorten the calibration work, and enhance the calibration precision.

The calibration-result storage section 214 is a storage device such as a ROM (Read Only Memory) or a RAM (Random Access Memory), and stores therein results of calibrations by the posture-sensor calibrating section 211, that is, the installation-angle error θt calculated by the posture-sensor calibrating section 211.

The posture-angle transforming section 212 computes the posture angle of each section by adding the installation-angle error (angle θt) output from the calibration-result storage section 214 to a result of sensing by each inertial measurement unit 13 to 16 (i.e. the angle of each inertial measurement unit 13 to 16 itself: sensing angle θs).

The excavator-posture calculating section 213 computes the posture of the hydraulic excavator 100 in accordance with the posture angle of each section calculated at the posture-angle transforming section 212.

In FIG. 4, the posture-sensor calibrating section 211 of the posture calculating device 21 includes processing sections related to a process of calculating installation errors that include: a first-posture-information storage section 211*a*; a first-axis-error calculating section 211*b*; a second-posture-information storage section 211*c*; a first-axis-angle calculating section 211*d*; a second-axis-angle calculating section 211*e*; and a second-axis-error calculating section 211*f*, and a control function section, not illustrated, which controls the entire process operation of the posture-sensor calibrating section 211.

Figure 10:
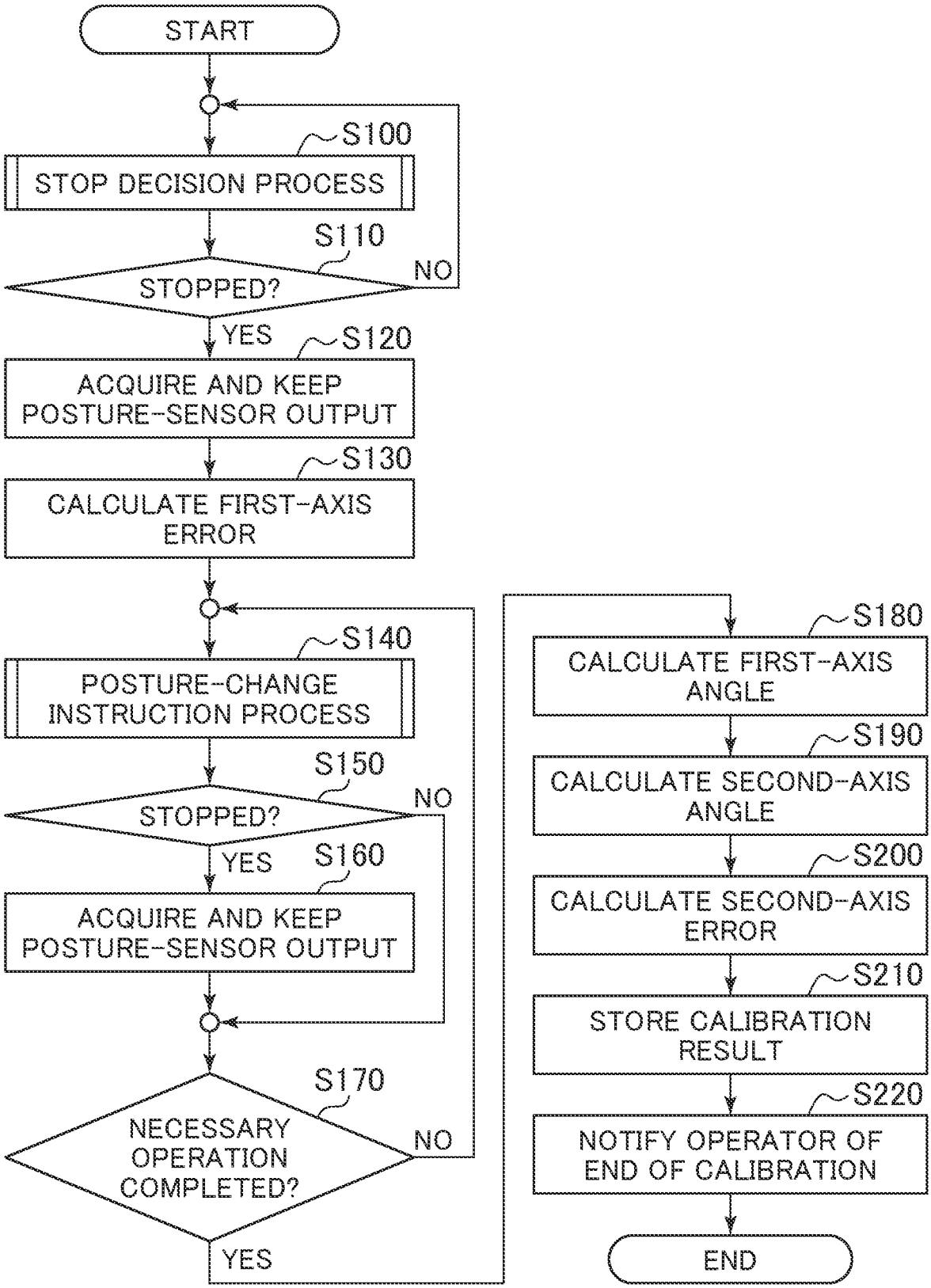
FIG. 10 is a flowchart illustrating processing contents of the posture calculating device.
Figure 11:
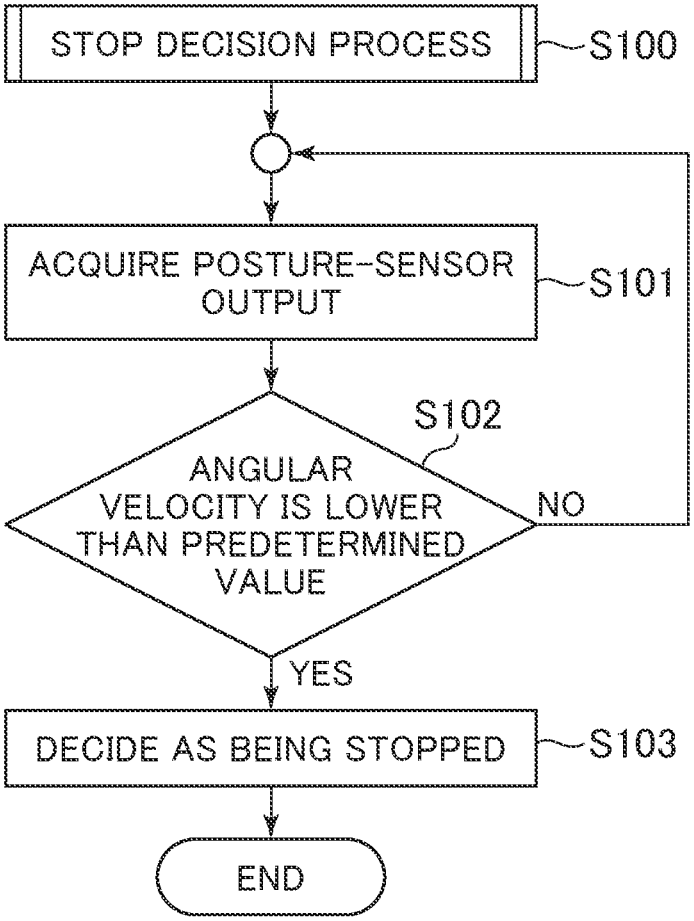
FIG. 11 is a flowchart illustrating processing contents of the posture calculating device.
Figure 12:
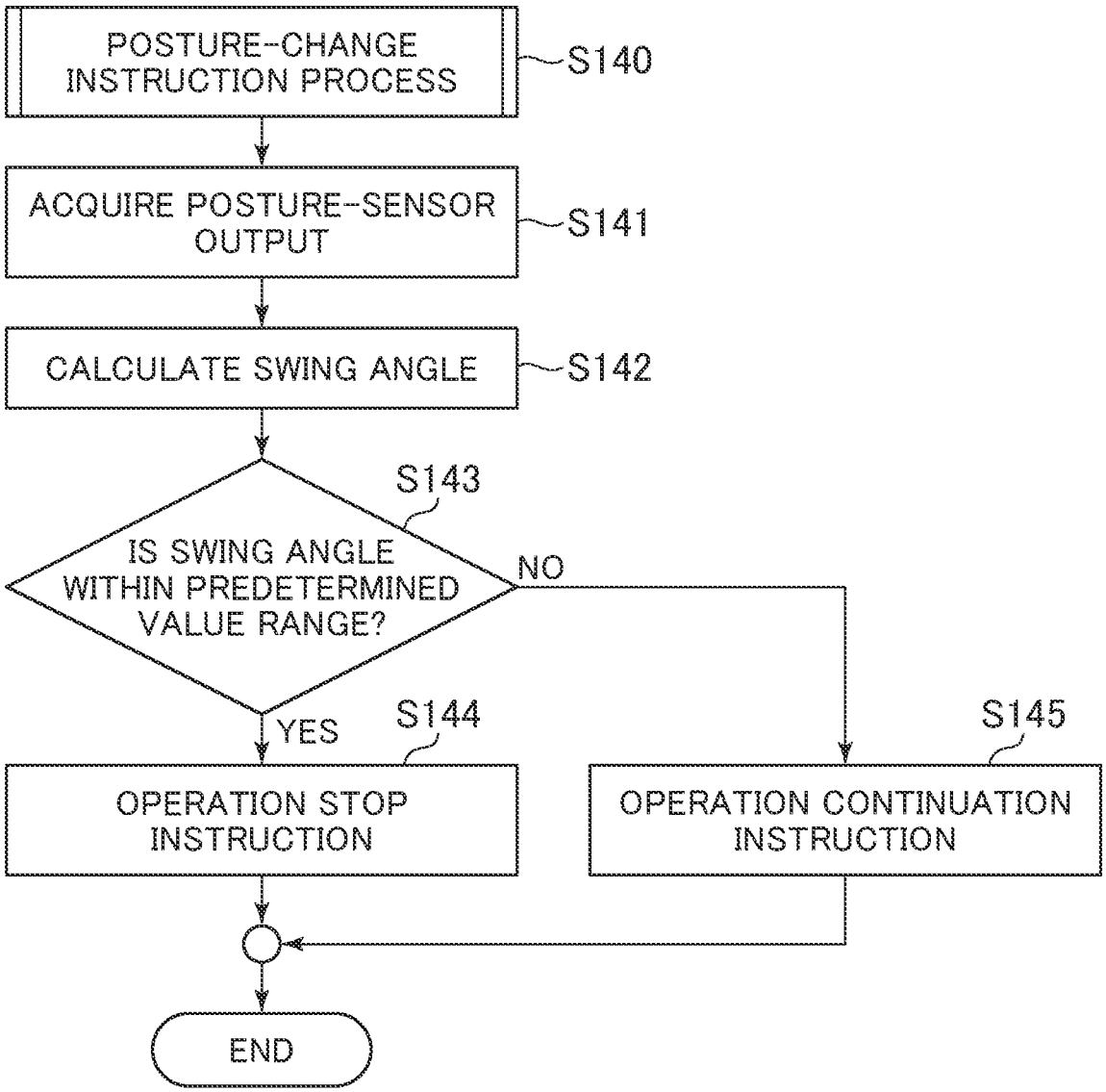
FIG. 12 is a flowchart illustrating processing contents of the posture calculating device.

In the following, a process of the posture calculating device 21 including the posture-sensor calibrating section 211 is explained with reference to FIG. 10 to FIG. 12. FIG. 10 to FIG. 12 are flowcharts illustrating processing contents of the posture calculating device 21.

The process of the calibration work at the posture calculating device 21 illustrated in FIG. 10 to FIG. 12 is started by an operator operating a console mounted in the cab 9, for example. In addition, if the monitor that is used to display guidance instructions is a touch-panel tablet PC, the monitor may be given the function of the console.

In FIG. 10, when the calibration work is started, the posture-sensor calibrating section 211 of the posture calculating device 21 first performs a stop-decision process (Step S100). As illustrated in FIG. 11, in the stop-decision process, first, output values of the inertial measurement units 13 to 16, which are posture sensors, are acquired (Step S101), it is decided whether or not all angular velocities (here, the absolute values) obtained from the output values of the inertial measurement units 13 to 16 are lower than a predetermined threshold that is determined in advance (Step S102), and, when the result of the decision is NO, the processes of Steps S101 and S102 are repeated. At this time, the threshold is desirably set to a positive value which is not 0 (zero) considering gyro bias.

In addition, when the result of the decision at Step S102 is YES, that is, when all the angular velocities obtained from the output values of the inertial measurement units 13 to 16 are lower than the predetermined threshold, it is decided that the hydraulic excavator 100 is in a stopped state where it is not performing work (Step S103), and the stop-decision process is repeated until the result of the decision indicates that the hydraulic excavator 100 is in a stopped state (Step S110). When the result of the decision at Step S110 is YES, the sensed values of the inertial measurement units 13 to 16 measured in the initial posture (first posture) at the start of the calibration are stored in the first-posture-information storage section 211*a* (Step S120).

Subsequently, the first-axis-error calculating section 211*b* computes the installation error φt0 of the machine-body inertial measurement unit 13 in the roll-angle direction (first axis) on the basis of the basic principle mentioned above, from the information of the inertial measurement units 13 to 16 in the first posture that is stored in the first-posture-information storage section 211*a* (Step S130).

Subsequently, the posture-sensor calibrating section 211 of the posture calculating device 21 performs a posture-change instruction process (Step S140). The posture changing process is a process of instructing an operator to swing the upper swing structure 2 by operating the operation levers 9*a* and 9*b* in order to acquire information for performing a calibration of the pitch angle (second axis).

The instruction to the operator in the posture changing process may be given by successively changing display contents in accordance with the swing angle. In addition, possible methods of the instruction to the operator in the posture-change instruction process include, for example, a method of displaying instruction contents on the monitor in the cab 9 via the monitor display controller 22, a method of notifying the operator of instruction contents by a sound, and the like.

As illustrated in FIG. 12, in the posture-change instruction process, the posture-sensor calibrating section 211 of the posture calculating device 21 first acquires the output values of the inertial measurement units 13 to 16, which are posture sensors, (Step S141), and calculates the swing angle of the upper swing structure 2 relative to the lower travel structure 3 from the initial posture (first posture) (Step S142). The calculation of the swing angle is obtained by integrating the output values (angular velocities) of the inertial measurement units 13 to 16 acquired at Step S141.

Subsequently, it is decided whether or not the swing angle is within the range of predetermined values (thresholds) (Step S143). For example, when the output values of the inertial measurement units 13 to 16 are acquired for every 10 degrees of the swing angle from the initial posture, ranges each including 10 degrees are specified as the ranges of the predetermined values. By setting the ranges of the predetermined values to ranges each including angles of integer multiples of 10 degrees, output values for every 10 degrees can be acquired.

When the result of the decision at Step S143 is YES, the operator is instructed to stop the swing operation (Step S144). In addition, when the result of the decision at Step S143 is NO, the operator is instructed to continue the swing operation (Step S145). In this manner, after the instruction to the operator is started, the work instruction is desirably continued until a predetermined angle is reached. In addition, at that time, the state of progress is desirably notified to the operator.

When the posture-change instruction process at Step S140 is ended, it is decided whether or not the hydraulic excavator 100 has been stopped, that is, whether or not all the angular velocities (here, the absolute values) obtained from the output values of the inertial measurement units 13 to 16 are lower than the predetermined threshold that is determined in advance (Step S150). The decision at Step S150 is a process for avoiding a situation where (Formula 14) described above is not established due to the centrifugal acceleration generated by the swing operation, and the angular velocities need not be strictly 0 (zero); therefore, a decision condition different from that at Step S110 may be set.

When the result of the decision at Step S160 is YES, the measured sensed values of the inertial measurement units 13 to 16 are stored in the second-posture-information storage section 211*c* (Step S160), and it is decided whether or not necessary operation has been completed (Step S170). In addition, when the result of the decision at Step S150 is NO, subsequently, it is decided whether or not necessary operation has been completed (Step S170).

In the case of the result of the decision at Step S170 is NO, that is, when it is decided that the acquisition of information necessary for the following calculation has not been completed, the processes of Steps S140 to S160 are repeated. The necessary information is, specifically, the output values of the inertial measurement units 13 to 16 for every 10 degrees of the swing angle from the basic posture at the swing angle of 0 degrees to the posture of the swing angle of 90 degrees or larger, for example. By repeating the processes at Steps S140 to S160, the postural information can be acquired almost at intervals of 10 degrees of the swing angle.

Note that, while it becomes possible to obtain more ideal plot waveforms if smaller values (narrower ranges) are set for the predetermined ranges used for the decision at Step S143, it takes a higher skill of the operator to keep the swing angle within those predetermined ranges. Therefore, burdens on the operator are reduced preferably by setting the predetermined ranges to those predetermined ranges ±1 degree approximately, for example. Even if the swing angle differs by approximately 1 degree, the influence on computation results of the pitch-angle installation error is extremely small.

When the result of the decision at Step S170 is YES, the first-axis-angle calculating section 211*d* uses the installation error computed at the first-axis-error calculating section 211*b* to compute the roll angle (the angle about the first axis) of the upper swing structure 2 (Step S180). This calculation is executed on the entire data stored in the second-posture-information storage section 211*c*. For example, when postural information (the sensed values of the inertial measurement units 13 to 16) for every 10 degrees in the range of the swing angle of 0 degrees to 90 degrees is stored in the second-posture-information storage section 211*c*, a relation between the swing angle and the roll angle (sensed values) is drawn in accordance with those pieces of information, and the true roll angle can be drawn by performing a shift calculation by the amount of the installation error computed at the first-axis-error calculating section 211*b*.

Subsequently, the second-axis-angle calculating section 211*e* performs a calculation of the pitch angle on the basis of the roll angle calculated at the first-axis-angle calculating section 211*d* (Step S190). Here, the calculation of the pitch angle corresponds to operation of computing the true pitch angle B1 by displacing the phase of the true roll angle A1 by 90 degrees as explained with reference to FIG. 9.

Subsequently, on the basis of information (sensed values of the roll angle) related to the acceleration stored in the second-posture-information storage section 211*c*, the second-axis-error calculating section 211*f* computes the pitch angle at each swing angle (e.g. equivalent to the pitch angle B2 (sensed value) in FIG. 9), and compares the pitch angle with the pitch angle which is a calculation result of the second-axis-angle calculating section 211*e* to thereby compute pitch-angle installation errors (second-axis errors) of the inertial measurement units 13 to 16 (Step S200).

Subsequently, the posture-sensor calibrating section 211 feeds the result (installation errors) of the calculation at the second-axis-error calculating section 211*f* to the calibration-result storage section 214, and causes the calibration-result storage section 214 to store the results therein (Step S210). Information representing that the calibration process is ended is displayed on the monitor in the cab 9 via the monitor display controller 22, the operator is notified of the end of the calibration process (Step S220), and the process ends.

Advantages in the thus-configured present embodiment are explained.

For calculations of the posture of the work implement, sensors such as inertial measurement units (IMUs) need to be used to sense the rotation angles of the boom, the arm, and the bucket. In addition, for highly-precise posture calculations, it is necessary to accurately grasp the installation positions, angles, and the like of the sensors. Typically, because dedicated jigs and the like are used for the sensor-installation work, installation errors are as small as approximately several degrees. However, because the link length of each member of the front work implement in the hydraulic excavator is in the order of several meters, even installation errors of several degrees have very significant influence on calculation results of the claw-tip position. For example, if a 20-t class hydraulic excavator is considered, when it is in the posture to have the longest front-implement length (so-called max reach), the length becomes approximately 10 m. In this posture, even if an error of a sensor of the machine body is 0.5 degrees, the error of the height of the claw-tip position of the work device (bucket) is computed as 10 $m \times \sin(0.5 \times \pi/180) \approx 0.09$ m, and the error of the height of the claw-tip position becomes as large as 9 cm.

There is a conventional technology that corrects installation errors that occur when gyro sensors are installed on a work machine. However, as has been known generally, outputs of gyro sensors have some bias (gyro bias), and accordingly, the gyro sensors inevitably output some values even in axial directions in which angular velocities are not actually generated. In addition, because the gyro bias significantly changes due to the temperatures of sensor elements and the like inevitably, it can be considered that the precision of calibrations varies significantly depending on environments where calibration operation is performed. Accordingly, in the conventional technology that does not take the influence of the gyro bias into consideration, output values from gyro sensors are values that have errors from true installation angles due to the influence of the gyro bias.

In contrast, in the present embodiment, in the work machine including: the machine body including the lower travel structure 3, and the upper swing structure 2 provided swingably provided to the lower travel structure 3; the articulated-type work implement (e.g. the front work implement 1) that is installed on the machine body, and includes the plurality of pivotably-coupled front-implement members (e.g. the boom 4, the arm 5, and the bucket 6); the one or more first-posture sensors (e.g. the inertial measurement units 14 to 16) that are provided to at least one front-implement member of the work implement, and sense postural information of the at least one front-implement member; the second-posture sensor (e.g. the inertial measurement unit 13) that is provided to the upper swing structure 2, and senses the postural information of the upper swing structure 2; and the controller (controller 20) that computes an installation error of the second-posture sensor, the controller is configured to: compute an installation error of the second-posture sensor around a first axis that is set forward perpendicularly to a swing axis of the upper swing structure 2, on a basis of sensing results of the first-posture sensors and the second-posture sensor obtained while the upper swing structure 2 is in a first calibration posture (initial posture) in which the upper swing structure 2 faces a predetermined direction relative to the lower travel structure 3; and compute an installation error of the second-posture sensor around a second axis that is set laterally perpendicularly to the swing axis of the upper swing structure 2, and to the first axis, on a basis of a sensing result of the second-posture sensor obtained while the upper swing structure 2 is in a second calibration posture in which the upper swing structure 2 is swung by 90 degrees relative to the lower travel structure 3 from the first calibration posture, and the installation error of the second-posture sensor around the first axis. Accordingly, without the necessity for taking the gyro bias into consideration, installation errors of sensors for sensing postural information can be computed precisely, and the sensor calibration precision can be enhanced.

In addition, because sensors installed on the machine body are often installed in the housing of the upper swing structure or in the cab, it is not easy to check their installation positions from the outside. In addition, while the center of pivoting motion of each member of the front work implement can be determined uniquely as the pin position of each link, the rotation center in pitch direction (the inclination direction in the forward/backward direction), or the roll direction (the inclination direction in the leftward/rightward direction) of the upper swing structure cannot be determined uniquely. Because of this, unlike sensors that are installed on the boom, the arm, the bucket, and the like of the front work implement, it is not easy to perform calibrations by using an external measuring device such as a total station.

In contrast, in the present embodiment, it is not necessary to measure the machine-body inertial measurement unit 13 installed on the upper swing structure 2 by using an external measuring device like a total station. Accordingly, calibrations of the inertial measurement unit can be performed more easily.

Second Embodiment

A second embodiment of the present invention is explained with reference to FIG. 13 and FIG. 14.

In the present embodiment, a roll-angle installation error of an inertial measurement unit is calculated on the basis of a result of a measurement of the front work implement by an external measuring device.

Figure 13:
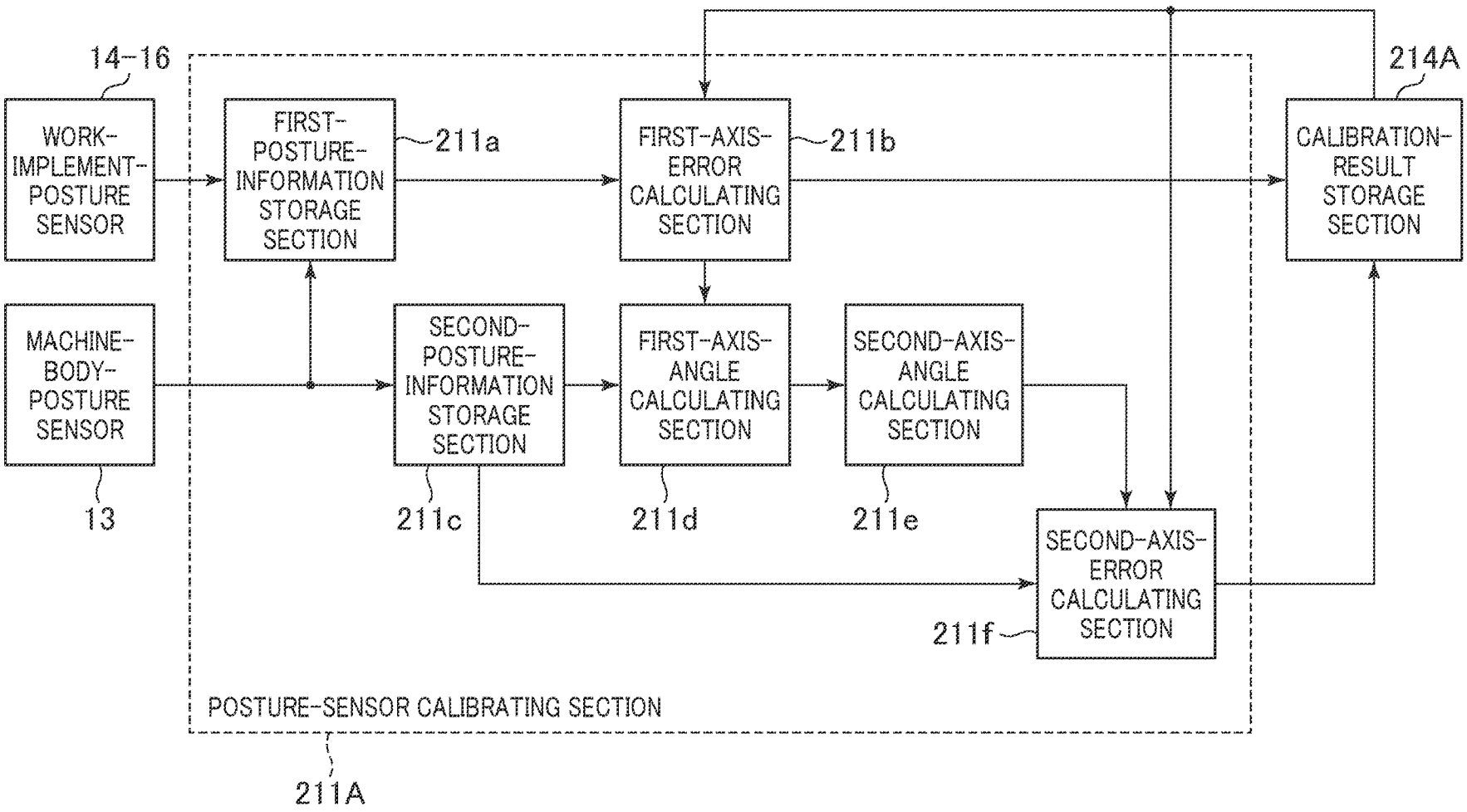
FIG. 13 is a functional block diagram schematically illustrating a processing function of the posture-sensor calibrating section of the posture calculating device in the second embodiment.

FIG. 13 is a functional block diagram schematically illustrating a processing function of the posture-sensor calibrating section of the posture calculating device in the present embodiment. In addition, FIG. 14 is a flowchart illustrating processing contents of the posture calculating device 21 in the present embodiment. In the figures, members that have counterparts in the first embodiment are given the same reference characters, and explanations thereof are omitted.

First, the basic principle of a calibration process in the present embodiment is explained.

As illustrated in FIG. 8, in a case considered here, the three-dimensional coordinates of a boom-foot-pin position P1 (xa, ya, za), and a boom-tip-pin position P2 (xb, yb, zb) in the front work implement 1 of the hydraulic excavator 100 are measured by an external measuring device such as a total station. At this time, a roll angle φ1mes of the front work implement 1 acquired at the external measuring device by using the coordinates of the positions P1 and P2 can be represented by (Formula 16) described below.

[Equation 16]

$$\phi_{1mes} = \tan^{-1}\left(\frac{yb - ya}{xb - xa}\right) \quad \text{(Formula 16)}$$

Note that it is supposed about (Formula 16) described above that the front work implement 1 is parallel to the lower travel structure 3 (i.e. the front work implement 1 is in the unswung posture).

By comparing the roll angle φ1mes of the front work implement 1 acquired at the external measuring device, and the roll angle φ1 acquired at the inertial measurement unit 14, for example, an installation error φt1 of the boom inertial measurement unit 14 can be obtained in accordance with (Formula 17) described below.

[Equation 17]

$$\phi_{t1}=\phi_{1mes}-\phi_1 \quad \text{(Formula 17)}$$

Here, by computing a slope inclination φg by using (Formula 6) and (Formula 17) described above, the installation error φt0 of the machine-body inertial measurement unit 13 can be computed in accordance with (Formula 18) described below which is obtained by deforming Formula (5) described above.

[Equation 18]

$$\phi_{t0}=\phi_{1mes}-\phi_0 \quad \text{(Formula 18)}$$

By performing a calibration of the boom inertial measurement unit 14 by using the external measuring device, and using a result of the calibration in this manner, it is possible to indirectly compute an installation error of the machine-body inertial measurement unit 13, and perform a calibration. Note that, while a result of a calibration of the boom inertial measurement unit 14 by the external measuring device is used to compute the installation error φt0 of the machine-body inertial measurement unit 13 in the case illustrated and explained in the present embodiment, the installation error φt0 of the machine-body inertial measurement unit 13 can be computed by using (Formula 17) and (Formula 18) described above similarly, even when results of calibrations of the arm inertial measurement unit 15 and the bucket inertial measurement unit 16 by the external measuring device are used.

In FIG. 13, a posture-sensor calibrating section 211A includes processing sections related to a process of calculating installation errors that include: the first-posture-information storage section 211*a*; the first-axis-error calculating section 211*b*; the second-posture-information storage section 211*c*; the first-axis-angle calculating section 211*d*; the second-axis-angle calculating section 211*e*; and the second-axis-error calculating section 211*f*, and the control function section, not illustrated, which controls the entire process operation of the posture-sensor calibrating section 211.

In the following, a process of the posture calculating device 21 including the posture-sensor calibrating section 211A is explained with reference to FIG. 14.

Figure 14:
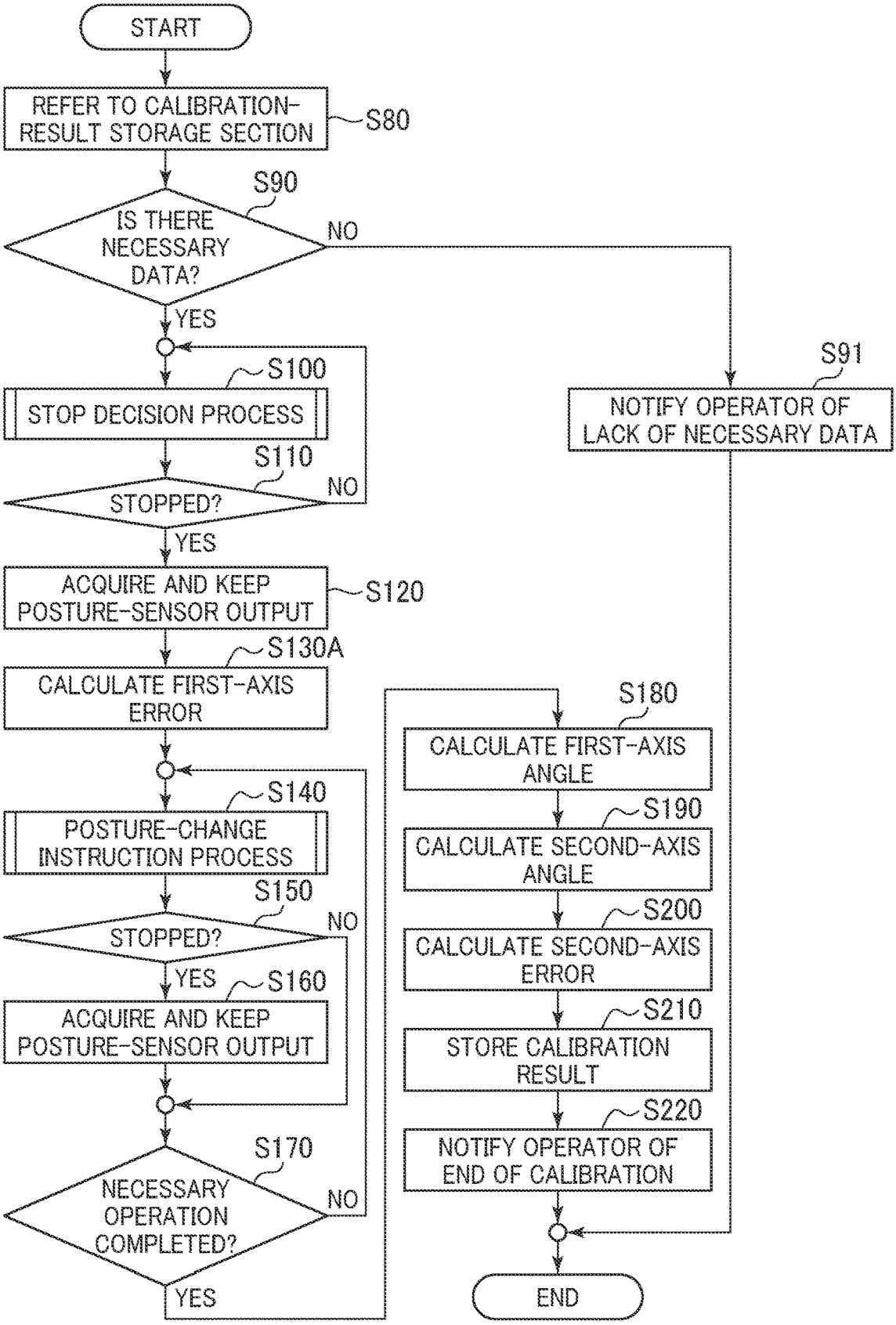
FIG. 14 is a flowchart illustrating processing contents of the posture calculating device in the second embodiment.

The process of the calibration work illustrated in FIG. 14 is started by an operator operating a console mounted in the cab 9, for example. In FIG. 14, when the calibration work is started, the posture-sensor calibrating section 211 first refers to a calibration-result storage section 214A (Step S80), and decides whether or not there is necessary data (Step S90). Here, the necessary data is a result of a calibration of the front work implement 1 by the external measuring device explained in the basic principle of the calibration process of the present embodiment. The necessary data is measured in advance by the external measuring device such as a total station, and stored in the calibration-result storage section 214A.

When the result of the decision at Step S90 is YES, the processes at Steps S100 to S220 are performed with the process at Step S130 in FIG. 10 of the first embodiment being replaced with the process at Step S130A of computing roll-angle installation errors of the inertial measurement units 13 to 16 on the basis of the basic principle of the present embodiment.

That is, at Step S130, the first-axis-error calculating section 211*b* computes the installation error φt0 of the machine-body inertial measurement unit 13 in the roll-angle direction (first axis) on the basis of the basic principle mentioned above from information of each inertial measurement unit 13 in the first posture stored in the first-posture-information storage section 211*a*, and results of calibrations of the inertial measurement units 14 to 16 by the external measuring device which are stored in the calibration-result storage section 214A (Step S130A).

In addition, when the result of the decision at Step S90 is NO, information representing that the necessary data is missing is displayed on the monitor in the cab 9 via the monitor display controller 22 to notify an operator of the information (Step S91), and the process ends.

In other respects, the configuration is similar to that of the first embodiment.

The thus-configured present embodiment also can provide advantages similar to those provided by the first embodiment.

Third Embodiment

A third embodiment of the present invention is explained with reference to FIG. 15 and FIG. 16.

In the present embodiment, a roll-angle installation error of an inertial measurement unit is calculated on the basis of a result of a measurement of the inertial measurement unit when the upper swing structure is swung relative to the lower travel structure.

Figure 15:
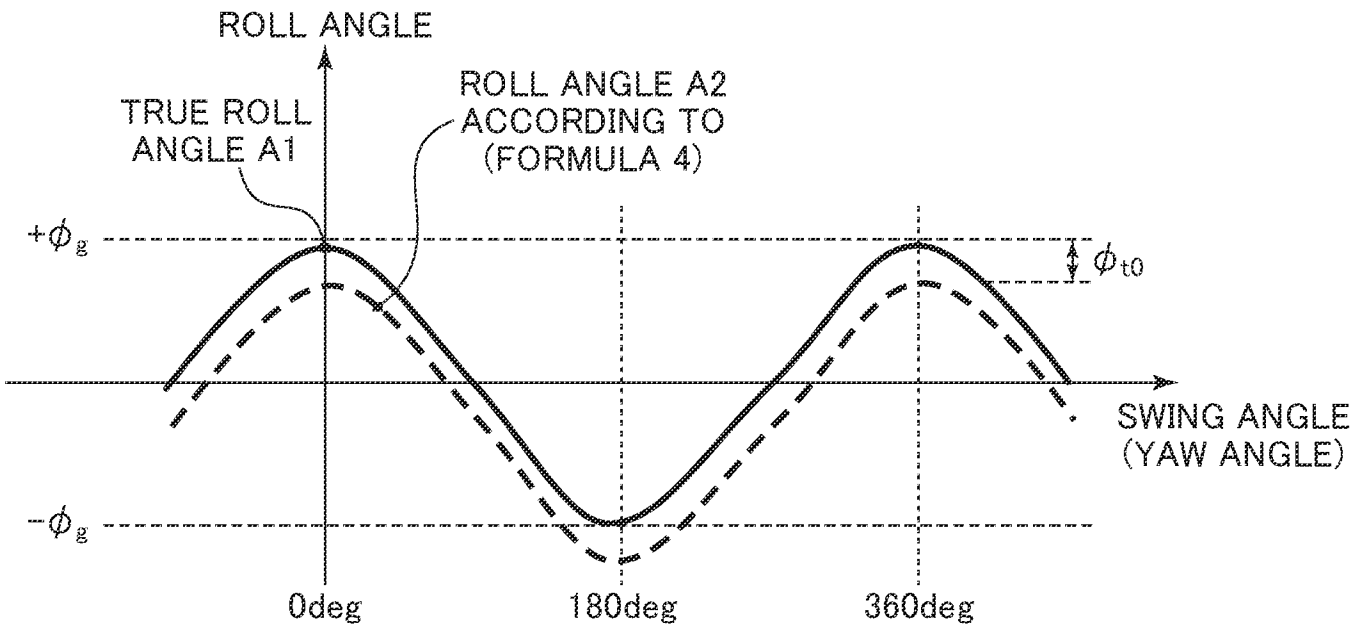
FIG. 15 is figure illustrating one example of changes of a measurement result of a true roll angle of the machine-body inertial measurement unit, and a roll angle as a result of sensing by the inertial measurement unit when the upper swing structure is swung relative to the lower travel structure.
Figure 16:
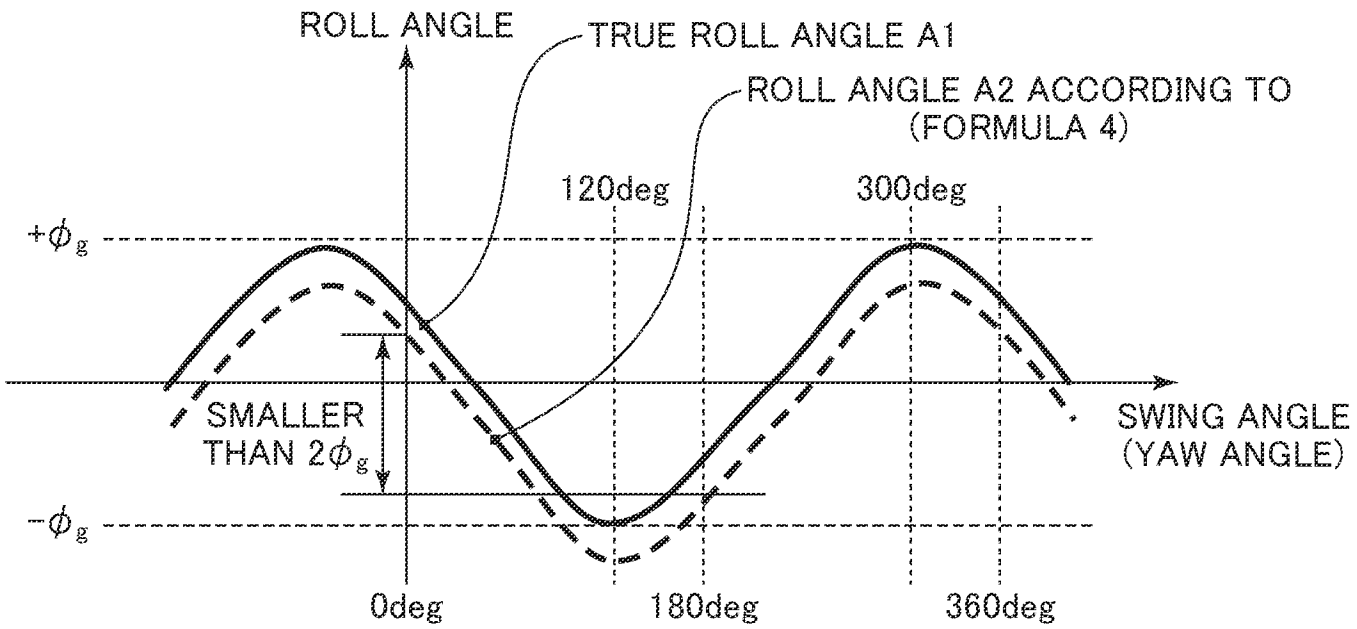
FIG. 16 is figure illustrating one example of changes of a measurement result of the true roll angle of the machine-body inertial measurement unit, and the roll angle as a result of sensing by the inertial measurement unit when the upper swing structure is swung relative to the lower travel structure.

FIG. 15 and FIG. 16 are figures illustrating one example of changes of a measurement result of a true roll angle of the machine-body inertial measurement unit, and a roll angle as a result of sensing by the inertial measurement unit when the upper swing structure is swung relative to the lower travel structure. The horizontal axes represent the swing angle, and the vertical axes represent the roll angle. In the figures, members that have counterparts in the first embodiment are given the same reference characters, and explanations thereof are omitted.

First, the basic principle of a calibration process in the present embodiment is explained.

For example, even if the machine-body inertial measurement unit 13 has the roll-angle installation error φt0, and the pitch-angle installation error θt0, the difference between the maximum value and minimum value of sensed values obtained in accordance with (Formula 4) described above when the upper swing structure 2 of the hydraulic excavator 100 is swung is twice the inclination angle φg.

FIG. 15 illustrates changes of a measurement result of the true roll angle of the machine-body inertial measurement unit, and the roll angle as a result of sensing by the inertial measurement unit when the upper swing structure is swung when the hydraulic excavator 100 is arranged such that the forward/backward direction of the upper swing structure 2 in the initial posture (the swing angle is 0 degrees) becomes orthogonal to the upward/downward direction of the slope with the inclination angle φg (see FIG. 7). Note that, because the upper swing structure 2 of the hydraulic excavator 100 can freely rotate to the left and right, the swing angle can have positive and negative values, but only the swing in the positive direction is illustrated for simplification of explanation.

First, when the swing angle is 0 degrees, the true roll angle A1 is equal to the slope angle φg, but the roll angle A2 computed in accordance with (Formula 4) described above has a value which is smaller by the installation error φt0, that is, a value which is equal to (φg−φt0). This relation is kept maintained even if the swing angle changes.

In addition, when the swing angle reaches 180 degrees, the direction of the upper swing structure 2 is inverted, and accordingly, the true roll angle A1 is equal to a value of (−φg). On the other hand, the roll angle A2 computed in accordance with (Formula 4) described above is equal to a value of (−φg−φt0). Accordingly, on the basis of these relations, if the value of the roll angle according to (Formula 4) described above when the swing angle is 180 degrees is subtracted from the value of the roll angle according to (Formula 4) described above when the swing angle is 0 degrees, the relation of (Formula 19) described below is obtained.

[Equation 19]

$$(\phi_g-\phi_{r0})-(-\phi_g-\phi_{r0})=2\phi_g \quad \text{(Formula 19)}$$

That is, by dividing both sides of (Formula 19) described above by 2, the inclination angle φg can be computed.

Note that, while the hydraulic excavator 100 is arranged such that the forward/backward direction of the upper swing structure 2 in the initial posture (the swing angle is 0 degrees) becomes orthogonal to the upward/downward direction of the slope with the inclination angle φg in the case considered with reference to FIG. 15, the initial posture is not necessarily in such a state.

In view of this, in a case considered here, as illustrated in FIG. 16, the forward/backward direction of the upper swing structure 2 in the initial posture (the swing angle is 0 degrees) is not orthogonal to the upward/downward direction of the slope with the inclination angle φg.

In FIG. 16, it can be known that the difference of the roll angle A2 between the case that the swing angle is 0 degrees and the case that swing angle is 180 degrees is obviously smaller than 2φg, and the difference of the roll angle A2 between the case that the swing angle is 120 degrees and the case that the swing angle is 300 degrees is 2φg. That is, it can be known that no matter what posture the initial posture is, the relational expression of (Formula 19) described above holds true if attention is paid to the maximum value and minimum value of values obtained about a swing angle in accordance with (Formula 4) described above.

The roll angle A2 in accordance with (Formula 4) in FIG. 15 and FIG. 16 can be plotted by performing a calculation according to (Formula 4) described above in accordance with output values (accelerations) of the machine-body inertial measurement unit 13 that are obtained when the upper swing structure 2 is swung. It should be noted however that, in order for the maximum value and minimum value of sensed values to be included in a plot waveform, swing operation with the swing angle equal to or larger than 180 degrees, and smaller than 360 degrees is necessary.

By using the inclination angle φg obtained in accordance with (Formula 19) described above, and the sensed value φ0 obtained in accordance with (Formula 4) described above, the roll-angle installation error φt0 of the machine-body inertial measurement unit 13 can be computed in accordance with (Formula 10) described above.

In other respects, the configuration is similar to those of the first and second embodiments.

The thus-configured third embodiment also can provide advantages similar to those provided by the first and second embodiments.

Next, features of the embodiments described above are explained.

(1) In the embodiments described above, in the work machine (e.g. the hydraulic excavator 100) including: the machine body including the lower travel structure 3, and the upper swing structure 2 swingably provided to the lower travel structure 3; the articulated-type work implement (e.g. the front work implement 1) that is installed on the machine body, and includes the plurality of pivotably-coupled front-implement members (e.g. the boom 4, the arm 5, and the bucket 6); the one or more first-posture sensors (e.g. the inertial measurement units 14 to 16) that are provided to at least one front-implement member of the work implement, and sense postural information of the at least one front-implement member; the second-posture sensor (e.g. the inertial measurement unit 13) that is provided to the upper swing structure, and senses postural information of the upper swing structure; and the controller (e.g. the controller 20) that computes an installation error of the second-posture sensor, the controller is configured to: compute an installation error of the second-posture sensor around a first axis that is set forward perpendicularly to a swing axis of the upper swing structure, on a basis of sensing results of the first-posture sensors and the second-posture sensor obtained while the upper swing structure is in a first calibration posture in which the upper swing structure faces a predetermined direction relative to the lower travel structure; and compute an installation error of the second-posture sensor around a second axis that is set laterally perpendicularly to the swing axis of the upper swing structure, and to the first axis, on a basis of a sensing result of the second-posture sensor obtained while the upper swing structure is in a second calibration posture in which the upper swing structure is swung by 90 degrees relative to the lower travel structure from the first calibration posture, and the installation error of the second-posture sensor around the first axis.

With this configuration, installation errors of sensors for sensing postural information can be computed precisely, and the sensor calibration precision can be enhanced.

(2) In addition, in the embodiments described above, in the work machine (e.g. the hydraulic excavator 100) according to (1), the controller (e.g. the controller 20) is configured to compute the installation error of the second-posture sensor (e.g. the inertial measurement unit 13) around the first axis on a basis of an average value of the sensing result of the first-posture sensors (e.g. the inertial measurement units 14 to 16), and the sensing result of the second-posture sensor obtained while the upper swing structure is in the first calibration posture.

(3) In addition, in the embodiments described above, in the work machine (e.g. the hydraulic excavator 100) according to (1), the controller (e.g. the controller 20) is configured to compute the installation error of the second-posture sensor (e.g. the inertial measurement unit 13) around the first axis on a basis of the sensing result of the first-posture sensors (e.g. the inertial measurement units 14 to 16) and the sensing result of the second-posture sensor obtained while the upper swing structure is in the first calibration posture, and an installation error of the first-posture sensors obtained by an external measuring device (e.g. a total station) that can measure an installation error of the first-posture sensors around the first axis from an outside of the work machine.

(4) In addition, in the embodiments described above, in the work machine (e.g. the hydraulic excavator 100) according to (1), the controller (e.g. the controller 20) is configured to compute the installation error of the second-posture sensor (e.g. the inertial measurement unit 13) around the first axis from a maximum value and a minimum value of the sensing result of the second-posture sensor obtained when the upper swing structure 2 is swung by 180 degrees or more relative to the lower travel structure 3 from the first calibration posture.

<Notes>

Note that the present invention is not limited to the embodiments described above, but includes various modification examples and combinations within the scope not deviating from the gist of the present invention. In addition, the present invention is not limited to embodiments that include all the configurations explained in the embodiments described above, but include embodiments from which some of the configurations are removed. In addition, the configurations, functionalities and the like described above may be partially or entirely realized by designing them on an integrated circuit, and so on, for example. In addition, the configurations, functionalities and the like described above may be realized by software, in which case a processor interprets a program to realize the individual functionalities and execute the functionalities.

DESCRIPTION OF REFERENCE CHARACTERS

1: Front work implement (work implement)
2: Upper swing structure
2*a*: Swing motor
3: Lower travel structure
3*a*: Travel motor
4: Boom
4*a*: Boom cylinder
5: Arm
5*a*: Arm cylinder
6: Bucket
6*a*: Bucket cylinder
7: Hydraulic pump apparatus
8: Control valve
9: Cab
9*a*, 9*b*: Operation lever (operation device)
13: Machine-body inertial measurement unit
14: Boom inertial measurement unit
15: Arm inertial measurement unit
16: Bucket inertial measurement unit
17: Construction information
18: Reception antenna
20: Controller
21: Posture calculating device
22: Monitor display controller
23: Hydraulic system controller
24: Construction-target-surface calculating device
100: Hydraulic excavator
211, 211A: Posture-sensor calibrating section
211*a*: First-posture-information storage section
211*b*: First-axis-error calculating section

211*c*: Second-posture-information storage section
211*d*: First-axis-angle calculating section
211*e*: Second-axis-angle calculating section
211*f*: Second-axis-error calculating section
212: Posture-angle transforming section
213: Excavator-posture calculating section
214, 214A: Calibration-result storage section

The invention claimed is:

1. A work machine comprising:

a machine body including a lower travel structure, and an upper swing structure swingably provided to the lower travel structure;

an articulated-type work implement that is installed on the machine body, and includes a plurality of pivotably-coupled front-implement members;

one or more first-posture sensors that are provided to at least one front-implement member of the work implement, and that sense postural information of the at least one front-implement member;

a second-posture sensor that is provided to the upper swing structure, and that senses postural information of the upper swing structure; and a controller configured to compute an installation error of the second-posture sensor, wherein the controller is configured to:

compute an installation error of the second-posture sensor around a first axis that is set forward perpendicularly to a swing axis of the upper swing structure, on a basis of sensing results of the first-posture sensors and the second-posture sensor obtained while the upper swing structure is in a first calibration posture in which the upper swing structure faces a predetermined direction relative to the lower travel structure, compute an installation error of the second-posture sensor around a second axis that is set laterally perpendicularly to the swing axis of the upper swing structure, and to the first axis, on a basis of a sensing result of the second-posture sensor obtained while the upper swing structure is in a second calibration posture in which the upper swing structure is swung by 90 degrees relative to the lower travel structure from the first calibration posture, and the installation error of the second-posture sensor around the first axis, and compute the installation error of the second-posture sensor around the first axis on a basis of an average value of the sensing result of the first-posture sensors, and the sensing result of the second-posture sensor obtained while the upper swing structure is in the first calibration posture.

2. A work machine comprising:

a machine body including a lower travel structure, and an upper swing structure swingably provided to the lower travel structure;

an articulated-type work implement that is installed on the machine body, and includes a plurality of pivotably-coupled front-implement members;

one or more first-posture sensors that are provided to at least one front-implement member of the work implement, and that sense postural information of the at least one front-implement member;

a second-posture sensor that is provided to the upper swing structure, and that senses postural information of the upper swing structure; and a controller configured to compute an installation error of the second-posture sensor, wherein the controller is configured to:

compute an installation error of the second-posture sensor around a first axis that is set forward perpendicularly to a swing axis of the upper swing structure, on a basis of sensing results of the first-posture sensors and the second-posture sensor obtained while the upper swing structure is in a first calibration posture in which the upper swing structure faces a predetermined direction relative to the lower travel structure, and compute the installation error of the second-posture sensor around the first axis from a maximum value and a minimum value of the sensing result of the second-posture sensor obtained when the upper swing structure is swung by 180 degrees or more relative to the lower travel structure from the first calibration posture.

* * * * *